US010645990B2

(12) United States Patent
Rushbrook

(10) Patent No.: US 10,645,990 B2
(45) Date of Patent: May 12, 2020

(54) ARTICLE OF FOOTWEAR WITH ADJUSTABLE SOLE

(71) Applicant: NIKE, Inc., Beaverton, OR (US)

(72) Inventor: Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 601 days.

(21) Appl. No.: 15/351,107

(22) Filed: Nov. 14, 2016

(65) Prior Publication Data

US 2017/0055626 A1 Mar. 2, 2017

Related U.S. Application Data

(63) Continuation-in-part of application No. 13/970,188, filed on Aug. 19, 2013, now Pat. No. 9,491,983.

(51) Int. Cl.

| | |
|---|---|
| ***A43B 3/26*** | (2006.01) |
| ***A43C 11/14*** | (2006.01) |
| ***A43C 11/16*** | (2006.01) |
| ***A43B 3/00*** | (2006.01) |
| ***A43B 13/12*** | (2006.01) |
| ***A43B 13/14*** | (2006.01) |
| ***A43B 13/16*** | (2006.01) |
| ***A43C 1/00*** | (2006.01) |

(52) U.S. Cl.

CPC ..... *A43B 3/26* (2013.01); *A43B 3/0005* (2013.01); *A43B 13/12* (2013.01); *A43B 13/141* (2013.01); *A43B 13/16* (2013.01); *A43C 1/003* (2013.01); *A43C 11/14* (2013.01); *A43C 11/165* (2013.01)

(58) Field of Classification Search

CPC ..... A43B 3/0005; A43B 3/26; A43B 11/00; A43B 21/45; A43B 13/12; A43B 13/141; A43B 13/16; A43C 1/003; A43C 11/14; A43C 11/165

USPC ..... 36/83

See application file for complete search history.

(56) References Cited

U.S. PATENT DOCUMENTS

| | | | |
|---|---|---|---|
| 2,495,984 | A | 1/1950 | Roy |
| 4,654,985 | A | 4/1987 | Chalmers |
| 4,811,503 | A | 3/1989 | Iwama |
| 4,928,405 | A | 5/1990 | Spademan |
| 4,942,678 | A | 7/1990 | Gumbert |
| 5,205,055 | A | 4/1993 | Harrell |
| 5,241,762 | A | 9/1993 | Rosen |
| 5,291,671 | A | 3/1994 | Caberlotto et al. |
| 5,371,957 | A | 12/1994 | Gaudio |
| 5,381,609 | A | 1/1995 | Hieblinger |
| 5,404,658 | A | 4/1995 | Rosen |
| 5,729,912 | A | 3/1998 | Gutkowski et al. |
| 5,813,146 | A | 9/1998 | Gutkowski et al. |
| 5,839,210 | A | 11/1998 | Bernier et al. |

(Continued)

FOREIGN PATENT DOCUMENTS

FR 2619490 A1 2/1989

*Primary Examiner* — Anne M Kozak

(74) *Attorney, Agent, or Firm* — Banner & Witcoff, Ltd.

(57) ABSTRACT

An article of footwear includes an upper and a sole structure. The sole structure includes a gap extending longitudinally through the sole structure. A tensioning member extends through the sole structure and across the gap such that tensioning the tensioning member contracts the gap and pulls opposing sides of the sole structure together. As the sole structure contracts, the upper is pulled down on the foot, thereby tightening the upper around the foot.

20 Claims, 17 Drawing Sheets

(56) References Cited

U.S. PATENT DOCUMENTS

| | | | |
|---|---|---|---|
| 5,873,183 | A | 2/1999 | Posner |
| 6,032,387 | A | 3/2000 | Johnson |
| 6,052,921 | A | 4/2000 | Oreck |
| 6,052,924 | A | 4/2000 | Sabat |
| 6,286,233 | B1 | 9/2001 | Gaither |
| 6,378,230 | B1 | 4/2002 | Rotem et al. |
| 6,427,361 | B1 | 8/2002 | Chou |
| 6,438,872 | B1 | 8/2002 | Chil et al. |
| 6,467,194 | B1 | 10/2002 | Johnson |
| 6,505,424 | B2 | 1/2003 | Oorei et al. |
| 6,598,322 | B2 | 7/2003 | Jacques et al. |
| 6,643,954 | B2 | 11/2003 | Voswinkel |
| 6,691,433 | B2 | 2/2004 | Liu |
| 6,772,541 | B1 | 8/2004 | Ritter et al. |
| 6,807,754 | B2 | 10/2004 | Miller et al. |
| 7,076,843 | B2 | 7/2006 | Sakabayashi |
| 7,096,559 | B2 | 8/2006 | Johnson |
| 7,103,994 | B2 | 9/2006 | Johnson |
| 7,134,224 | B2 | 11/2006 | Elkington et al. |
| 7,200,957 | B2 | 4/2007 | Hubbard et al. |
| 7,287,342 | B2 | 10/2007 | Keen |
| 7,392,990 | B2 | 7/2008 | Bussiere |
| 7,428,471 | B2 | 9/2008 | Darley et al. |
| 7,540,100 | B2 | 6/2009 | Pawlus et al. |
| 7,568,298 | B2 | 8/2009 | Kerns |
| 7,627,963 | B2 | 12/2009 | Kilgore |
| 7,634,861 | B2 | 12/2009 | Kilgore |
| 7,721,468 | B1 | 5/2010 | Johnson et al. |
| 7,752,774 | B2 | 7/2010 | Ussher |
| 7,771,320 | B2 | 8/2010 | Riley et al. |
| 7,987,617 | B2 | 8/2011 | Kohatsu et al. |
| 8,056,269 | B2 | 11/2011 | Beers et al. |
| 8,074,379 | B2 | 12/2011 | Robinson, Jr. et al. |
| 8,112,251 | B2 | 2/2012 | Case, Jr. et al. |
| 8,141,277 | B2 | 3/2012 | Robinson et al. |
| 8,151,490 | B2 | 4/2012 | Sokolowski |
| 8,230,618 | B2 | 7/2012 | Bruce et al. |
| 8,312,646 | B2 | 11/2012 | Meschter et al. |
| 8,387,282 | B2 | 3/2013 | Baker et al. |
| 8,453,357 | B2 | 6/2013 | Beers et al. |
| 8,490,299 | B2 | 7/2013 | Dua et al. |
| 8,505,220 | B2 | 8/2013 | James et al. |
| 8,677,652 | B2 | 3/2014 | Marvin et al. |
| 8,875,418 | B2 | 11/2014 | Long |
| 8,881,430 | B2 | 11/2014 | Seamarks et al. |
| 8,904,672 | B1 | 12/2014 | Johnson |
| 8,973,288 | B2 | 3/2015 | Dojan et al. |
| 8,984,719 | B2 | 3/2015 | Soderberg et al. |
| 9,032,763 | B2 | 5/2015 | Meir et al. |
| 9,144,263 | B2 | 9/2015 | Elder et al. |
| 9,167,868 | B1 | 10/2015 | Koo |
| 2003/0066207 | A1 | 4/2003 | Gaither |
| 2004/0181972 | A1 | 9/2004 | Csorba |
| 2006/0117607 | A1 | 6/2006 | Pare et al. |
| 2006/0191164 | A1 | 8/2006 | Dinndort et al. |
| 2007/0011914 | A1 | 1/2007 | Keen et al. |
| 2007/0021269 | A1 | 1/2007 | Shum |
| 2007/0240334 | A1 | 10/2007 | Johnson |
| 2007/0266598 | A1 | 11/2007 | Pawlus et al. |
| 2008/0060167 | A1 | 3/2008 | Hammerslag et al. |
| 2008/0066272 | A1 | 3/2008 | Hammerslag et al. |
| 2008/0086911 | A1 | 4/2008 | Labbe |
| 2008/0307673 | A1 | 12/2008 | Johnson |
| 2009/0272007 | A1 | 11/2009 | Beers et al. |
| 2010/0063778 | A1 | 3/2010 | Schrock et al. |
| 2010/0115799 | A1 | 5/2010 | Welter et al. |
| 2010/0139122 | A1 | 6/2010 | Zanatta |
| 2010/0299959 | A1 | 12/2010 | Hammerslag et al. |
| 2011/0019939 | A1 | 1/2011 | Schwarz |
| 2011/0032105 | A1 | 2/2011 | Hoffman et al. |
| 2011/0199393 | A1 | 8/2011 | Nurse et al. |
| 2011/0258876 | A1 | 10/2011 | Baker et al. |
| 2012/0000091 | A1 | 1/2012 | Cotterman et al. |
| 2012/0004587 | A1 | 1/2012 | Nickel et al. |
| 2012/0007839 | A1 | 1/2012 | Tsao et al. |
| 2012/0023411 | A1 | 1/2012 | Ryu et al. |
| 2012/0251079 | A1 | 2/2012 | Satoh |
| 2012/0291564 | A1 | 2/2012 | Ananthachar et al. |
| 2012/0234111 | A1 | 9/2012 | Molyneux et al. |
| 2012/0240428 | A1 | 9/2012 | Knoll |
| 2012/0291563 | A1 | 11/2012 | Schrock et al. |
| 2013/0086816 | A1 | 4/2013 | Johnson et al. |
| 2013/0104429 | A1 | 5/2013 | Torres |
| 2013/0213144 | A1 | 8/2013 | Rice et al. |
| 2013/0213147 | A1 | 8/2013 | Rice et al. |
| 2013/0312293 | A1 | 11/2013 | Gerber |
| 2014/0068838 | A1 | 3/2014 | Beers et al. |
| 2014/0070042 | A1 | 3/2014 | Beers et al. |
| 2014/0082963 | A1 | 3/2014 | Beers |
| 2014/0182167 | A1 | 7/2014 | James et al. |
| 2014/0283412 | A1 | 9/2014 | Elder et al. |
| 2014/0338225 | A1 | 11/2014 | Bliss |
| 2015/0047222 | A1 | 2/2015 | Rushbrook |
| 2015/0089839 | A1* | 4/2015 | James ..... A43B 11/00 36/102 |
| 2015/0289595 | A1 | 10/2015 | Rushbrook et al. |
| 2015/0296922 | A1 | 10/2015 | Rushbrook et al. |
| 2016/0366980 | A1* | 12/2016 | Bell ..... A43C 1/04 |

* cited by examiner

ARTICLE OF FOOTWEAR WITH ADJUSTABLE SOLE

CROSS-REFERENCE TO RELATED APPLICATION

This application is a continuation-in-part of U.S. patent application Ser. No. 13/970,188, filed Aug. 19, 2013, which prior application is incorporated by reference herein in its entirety and made part hereof.

BACKGROUND

The present embodiments relate generally to articles of footwear and in particular to articles of footwear with soles.

Athletic shoes have two major components, an upper that provides the enclosure for receiving the foot, and a sole secured to the upper. The upper may be adjustable using laces, hook-and-loop fasteners or other devices to secure the shoe properly to the foot. The sole has the primary contact with the playing surface. The sole may be designed to absorb the shock as the shoe contacts the ground or other surfaces. The upper may be designed to provide the appropriate type of protection to the foot and to maximize the wearer's comfort.

SUMMARY

In one aspect, an article of footwear includes a forefoot portion, a midfoot portion and a heel portion. The article of footwear is associated with a longitudinal direction extending from the forefoot portion to the heel portion of the article of footwear. The article also includes an upper and a sole structure. The sole structure includes a gap extending through the sole structure in the longitudinal direction, where the gap separates a first side portion of the sole structure from a second side portion of the sole structure. The sole structure includes a tensioning member including a first end portion, a second end portion and an intermediate portion, where the intermediate portion extends from the first side portion to the second side portion and across the gap. Applying tension to the tensioning member can contract the gap so that the first side portion and the second side portion of the sole structure are moved closer together. The gap extends through a majority of a length of the sole structure.

In another aspect, an article of footwear includes a forefoot portion, a midfoot portion and a heel portion, as well as a longitudinal direction extending from the forefoot portion to the heel portion of the article of footwear. The article includes an upper and a sole structure. The sole structure includes a gap extending through the sole structure in the longitudinal direction, where the gap separates a first side portion of the sole structure from a second side portion of the sole structure. The sole structure includes a tensioning member including a first end portion, a second end portion and an intermediate portion, where the intermediate portion extends from the first side portion to the second side portion and across the gap and where the tensioning member can be used to control the size of the gap. The gap includes a first gap portion that extends from a first end portion of the gap to a gap vertex portion, and the first gap portion splits into a second gap portion and a third gap portion at the gap vertex portion. The first end portion is disposed in the forefoot portion, the second gap portion is disposed in the heel portion and the third gap portion is disposed in the heel portion.

In another aspect, an article of footwear includes a forefoot portion, a midfoot portion and a heel portion. The article includes a longitudinal direction extending from the forefoot portion to the heel portion of the article of footwear. The article includes an upper and a sole structure. The sole structure includes a gap extending through the sole structure in the longitudinal direction, where the gap separates a first side portion of the sole structure from a second side portion of the sole structure. The sole structure includes a tensioning member including a first end portion, a second end portion and an intermediate portion, where the intermediate portion extends from the first side portion to the second side portion and across the gap. Applying tension to the tensioning member can contract the gap so that the first side portion and the second side portion of the sole structure are moved closer together. The article includes at least one sensor for receiving information related to contact between the article of footwear and a ground surface, a tensioning device capable of automatically applying tension to the tensioning member and a control system in communication with the sensor and the tensioning device. The control unit controls the tensioning device in response to information from the sensor.

According to a further aspect, the gap may extend through the midsole member, and the outsole member may cover a bottom side of the gap. According to still further aspects, the midsole may include openings on the periphery on medial and lateral sides of the article, where portions of the tensioning member extend out of the periphery of the midsole through the openings. The article further includes one or more straps extending across the upper from the medial side to the lateral side of the article, wherein the portions of the tensioning member engage the strap(s), such that applying tension to the tensioning member can tighten the strap(s) around the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
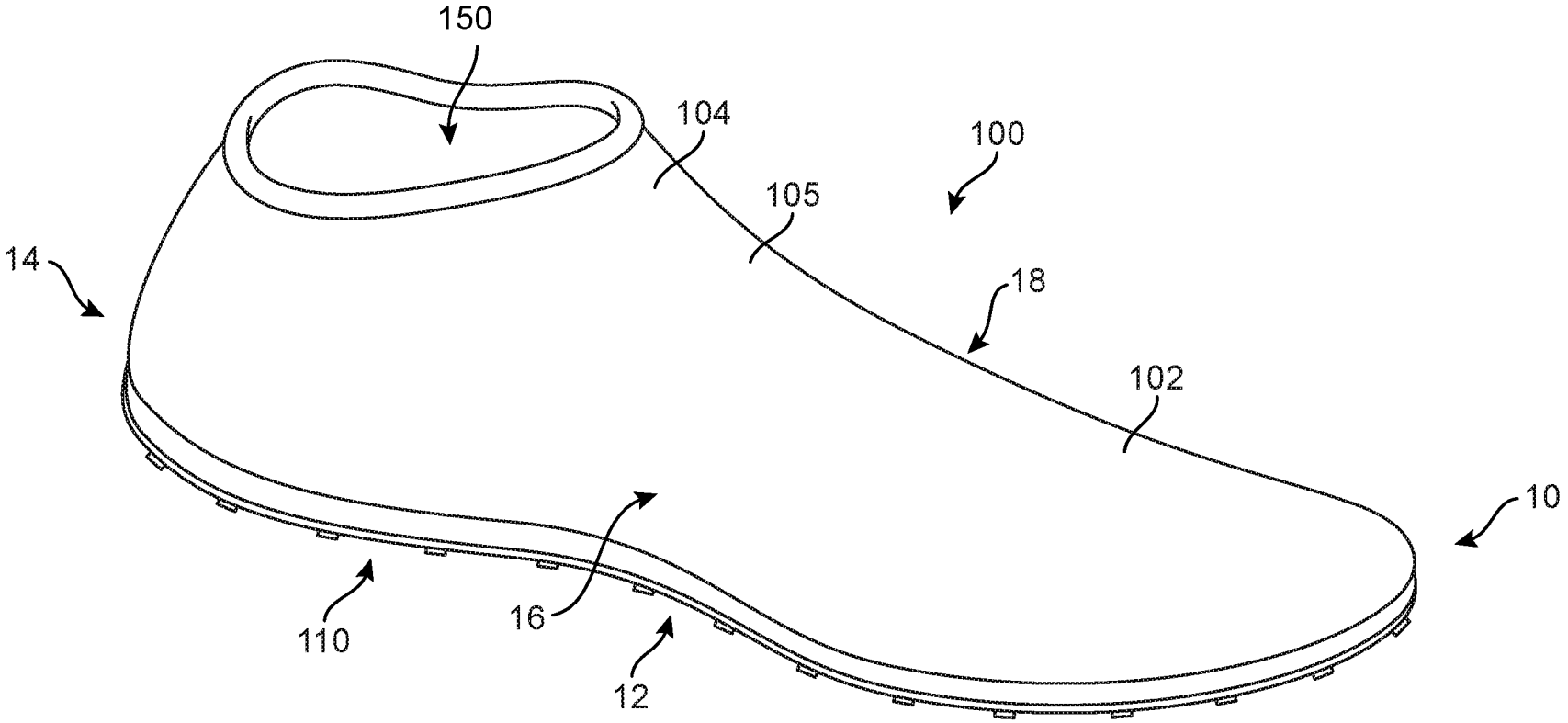
FIG. 1 is a schematic isometric view of an embodiment of an article of footwear.

FIG. 1 illustrates a schematic isometric view of an embodiment of an article of footwear 100, also referred to simply as article 100. The exemplary embodiment illustrates an article having the form of an athletic shoe, such as a running shoe. However, it will be understood that in other embodiments article 100 may take the form of various other kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may take the form of various kinds of non-sports related footwear, including, but not limited to: slippers, sandals, high heeled footwear, loafers as well as any other kinds of footwear. In still other embodiments, any of the systems, devices, components and processes discussed in this detailed description or shown in the figures could be used with various kinds of apparel and/or sporting equipment (e.g., gloves, helmets, etc.).

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending along a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be used in describing components of an article. In other words, each individual component of an article may have a corresponding longitudinal direction, a lateral direction and a vertical direction.

Article 100 may include an upper 102 as well as a sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe upper 102 could be a low top upper.

In some embodiments, upper 102 includes opening 150 that provides entry for the foot into an interior cavity of upper 102. In the exemplary embodiment, upper 102 includes an integrated tongue portion 104 that bounds opening 150 in a forward direction. However, in other embodiments, opening 150 may extend further into instep portion 105 of upper 102 and may include a separate tongue portion. Furthermore, in some other embodiments, upper 102 may be configured with a fastening system to control the size of opening 150, using, for example, laces, snaps, hook and loop fasteners as well as other kinds of fasteners. In an exemplary embodiment, upper 102 may not be provided with a fastening system. Instead, as discussed in further detail below, the fastening system may be incorporated into sole structure 110.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Figure 2:
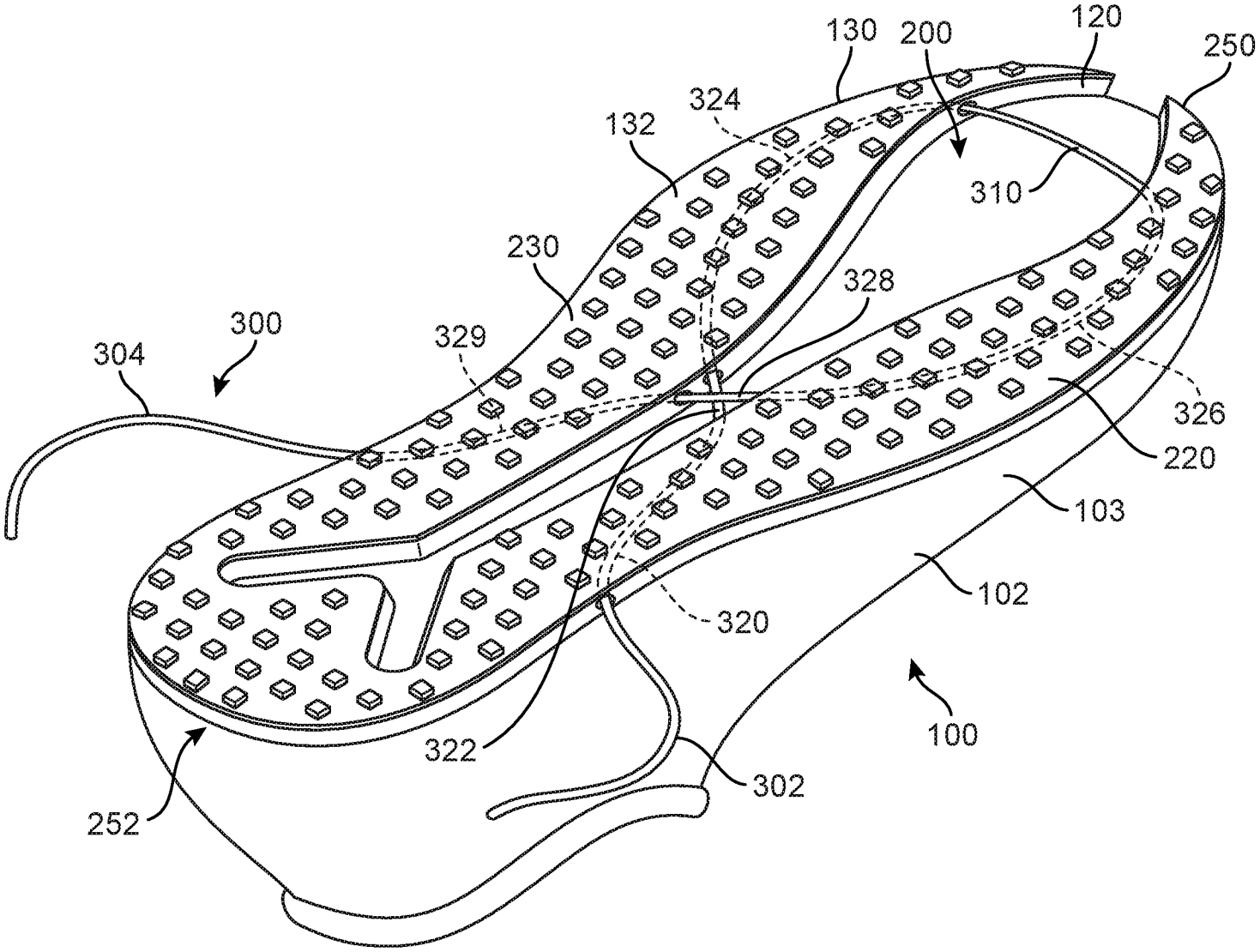
FIG. 2 is a schematic isometric view of a bottom side of an embodiment of an article of footwear.
Figure 3:
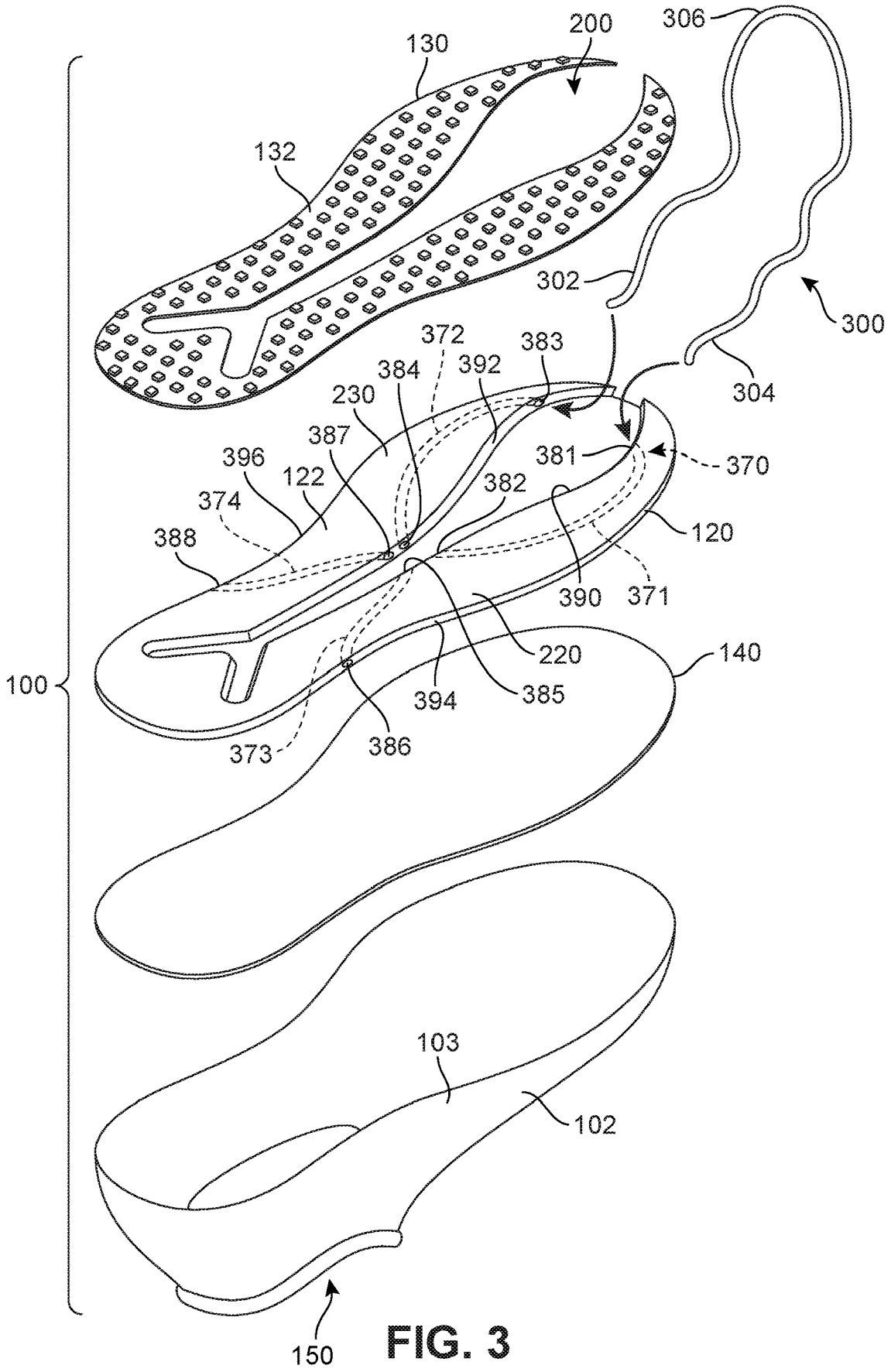
FIG. 3 is a schematic isometric exploded view of an embodiment of an article of footwear.

FIGS. 2 and 3 illustrate a bottom isometric view and a bottom isometric exploded view, respectively, of an embodiment of article 100. Referring to FIGS. 2 and 3, sole structure 110 comprises a midsole 120 and an outsole 130. Outsole 130 includes a ground contacting outer surface 132 and an inner surface 134 (see FIG. 4) that confronts, and attaches to, midsole 120. Midsole 120 may include a first surface 122 that confronts inner surface 134 of outsole 130, as well as a second surface 124 (see FIG. 4) that is oriented inwardly, or towards the interior of article 100.

In some embodiments, midsole 120 may be attached directly to upper 102, for example, along a lower periphery 103 of upper 102. In other embodiments, midsole 120 may be attached to a layer or component that is intermediate to upper 102 and midsole 120. For example, in some embodiments, article 100 may include an optional inner member 140. Inner member 140 could be an insole, a sockliner, a strobel layer and/or any other kind of component or layer associated with either an upper or a component of a sole.

The materials used for components of sole structure 110 may vary in different embodiments. Exemplary materials for outsole 130 include, but are not limited to: rubbers, plastics, composite materials or other kinds of materials known in the art for use with outsoles. Exemplary materials for midsole 120 include, but are not limited to: rubbers, plastics, composite materials as well as soft foams, hard foams, any other kinds of foams as well as any other materials known in the art for use with midsoles. As discussed in detail below, components of sole structure 110 may be configured to undergo some flexing or bending, and therefore materials for outsole 130 and/or midsole 120 may be selected to achieve the desired amount of flexing or bending.

Embodiments may include provisions to tighten an article around a foot by tensioning a sole structure. In some embodiments, an article can include an opening or gap in a sole structure. In some embodiments, the width of the opening or gap can be adjusted to tighten the article around a foot. In some embodiments, a tensioning member can be used to adjust the size of a gap in the sole structure, thereby adjusting the fit of the article on the foot.

As seen in FIGS. 2 and 3, sole structure 110 is configured with a gap 200. In some embodiments, gap 200 may generally extend in the longitudinal direction and may separate sole structure 110 into a first side portion 220 and a second side portion 230. As discussed in further detail below, first side portion 220 and second side portion 230 may be joined at regions of sole structure where gap 200 is not present, for example, at a rearward most edge 252 (see FIG. 4) of sole structure 110. However, in other embodiments, first side portion 220 and second side portion 230 may be completely separated, with no joined or attached portions.

In different embodiments, gap 200 may extend through some or all of the thickness of sole structure 110. In some embodiments, gap 200 may extend through the entire thickness of outsole 130. In some embodiments, gap 200 may extend through the entire thickness of midsole 120. In other embodiments, gap 200 may extend only partially through the thickness of outsole 130 and/or midsole 120. In an exemplary configuration, gap 200 extends through the entire thickness of both outsole 130 and midsole 120, thereby fully separating first side potion 220 and second side portion 230 in at least some portions of sole structure 110 (e.g., the portions forwards of rearward most edge 252).

In an exemplary embodiment, gap 200 does not extend through inner member 140. It is contemplated that in some embodiments, inner member 140 may provide protection to the foot and may block direct access to the interior cavity of upper 102 from below. However, it should be understood that in some embodiments, gap 200 could extend through some or all of the thickness of inner member 140. As previously discussed, in other embodiments, inner member 140 may be optional.

Article 100 may further include a tensioning member 300, which may be used to apply tension across portions of sole structure 110. As discussed in further detail below, tensioning member 300 may be used to pull first side portion 220 and second side portion 230 together, thereby contracting the size of gap 200 in order to tighten article 100 around the foot. In some embodiments, as gap 200 is contracted in size, first side portion 220 and second side portion 230 of sole structure 110 apply tension to lower periphery 103 of upper 102, thereby pulling upper 102 tighter against a foot that is disposed within upper 102.

Figure 4:
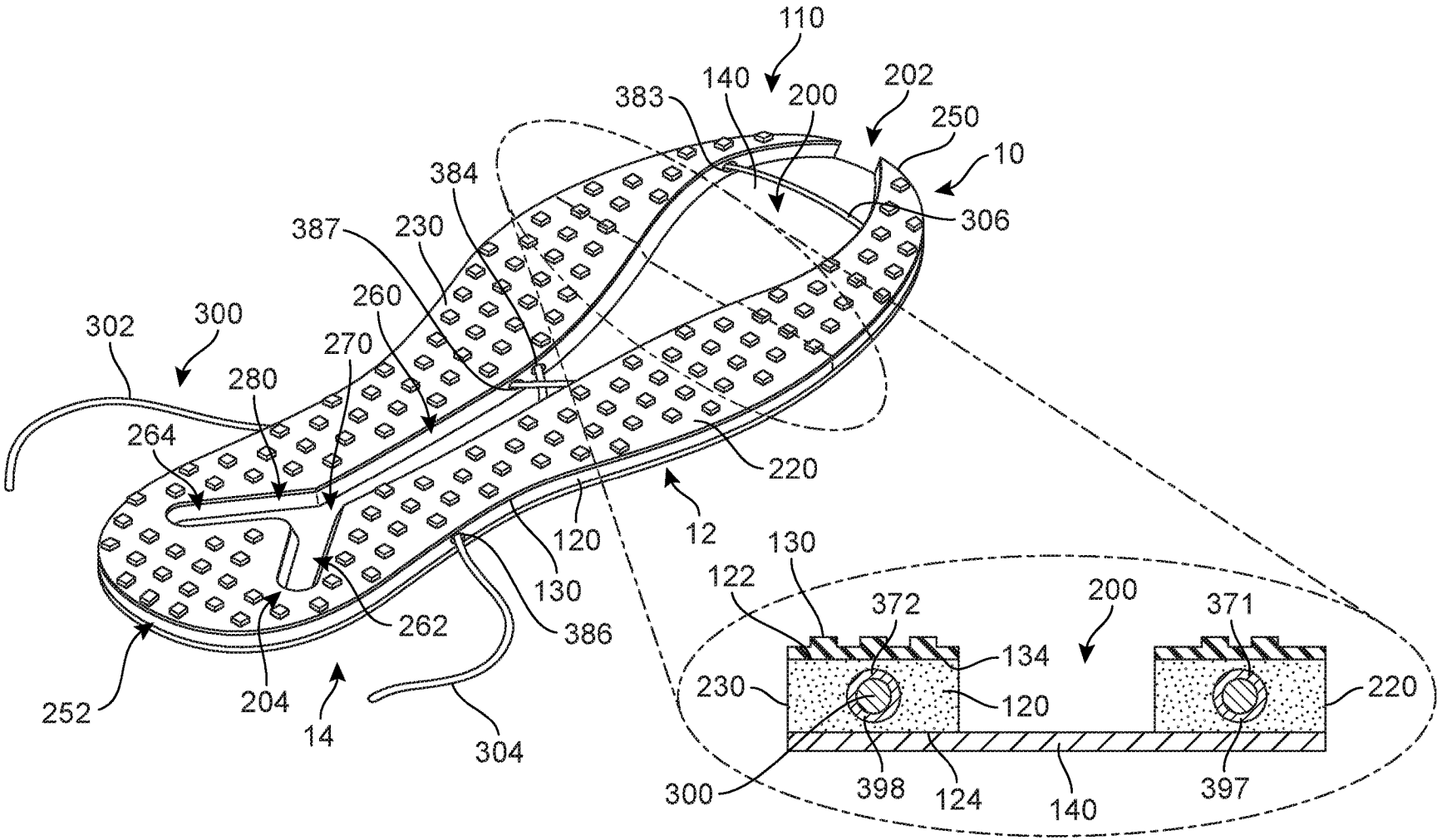
FIG. 4 is a schematic isometric view of an embodiment of a sole structure including an enlarged cross-sectional view.
Figure 5:
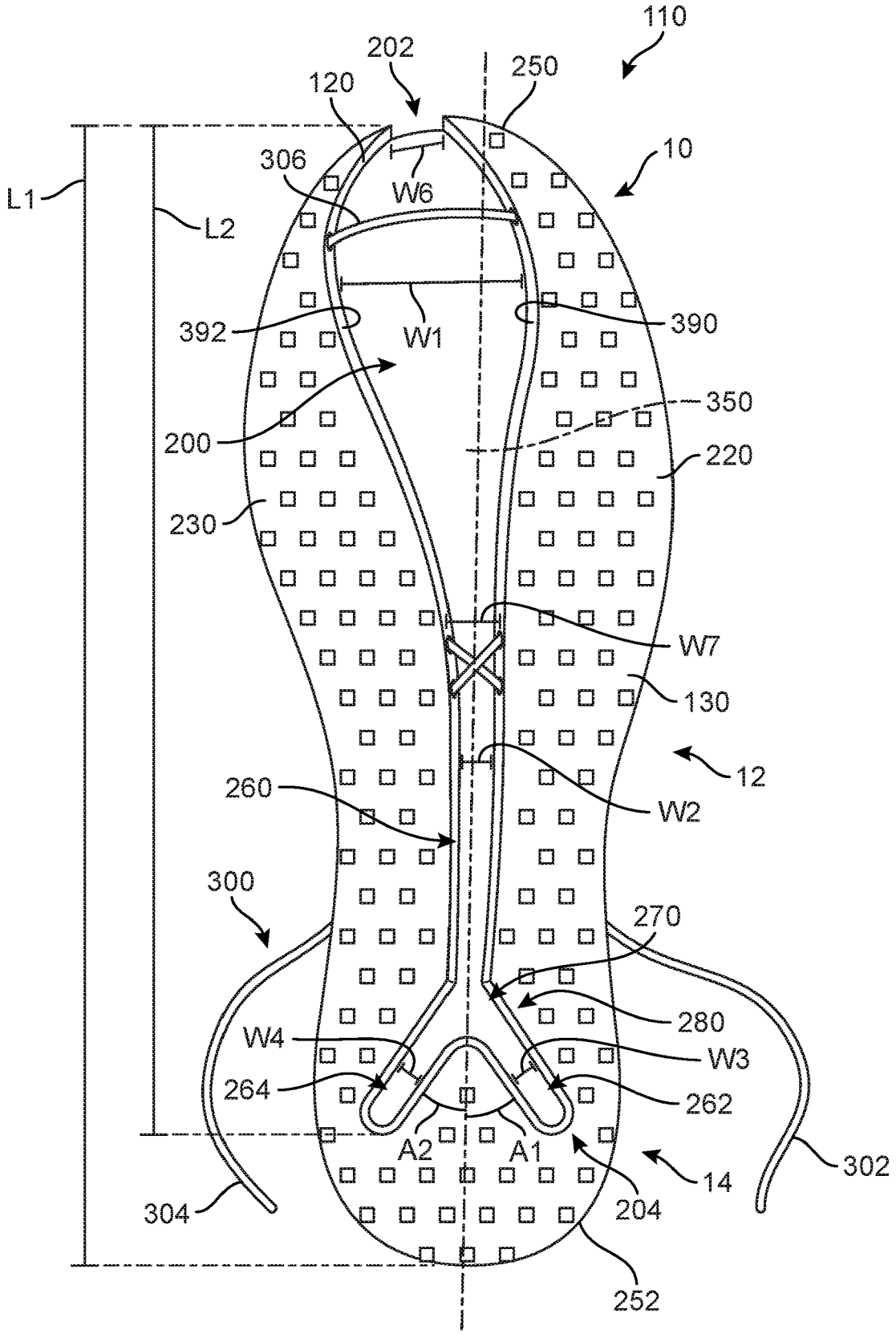
FIG. 5 is a schematic view of a bottom side of an embodiment of an article of footwear.
Figure 6:
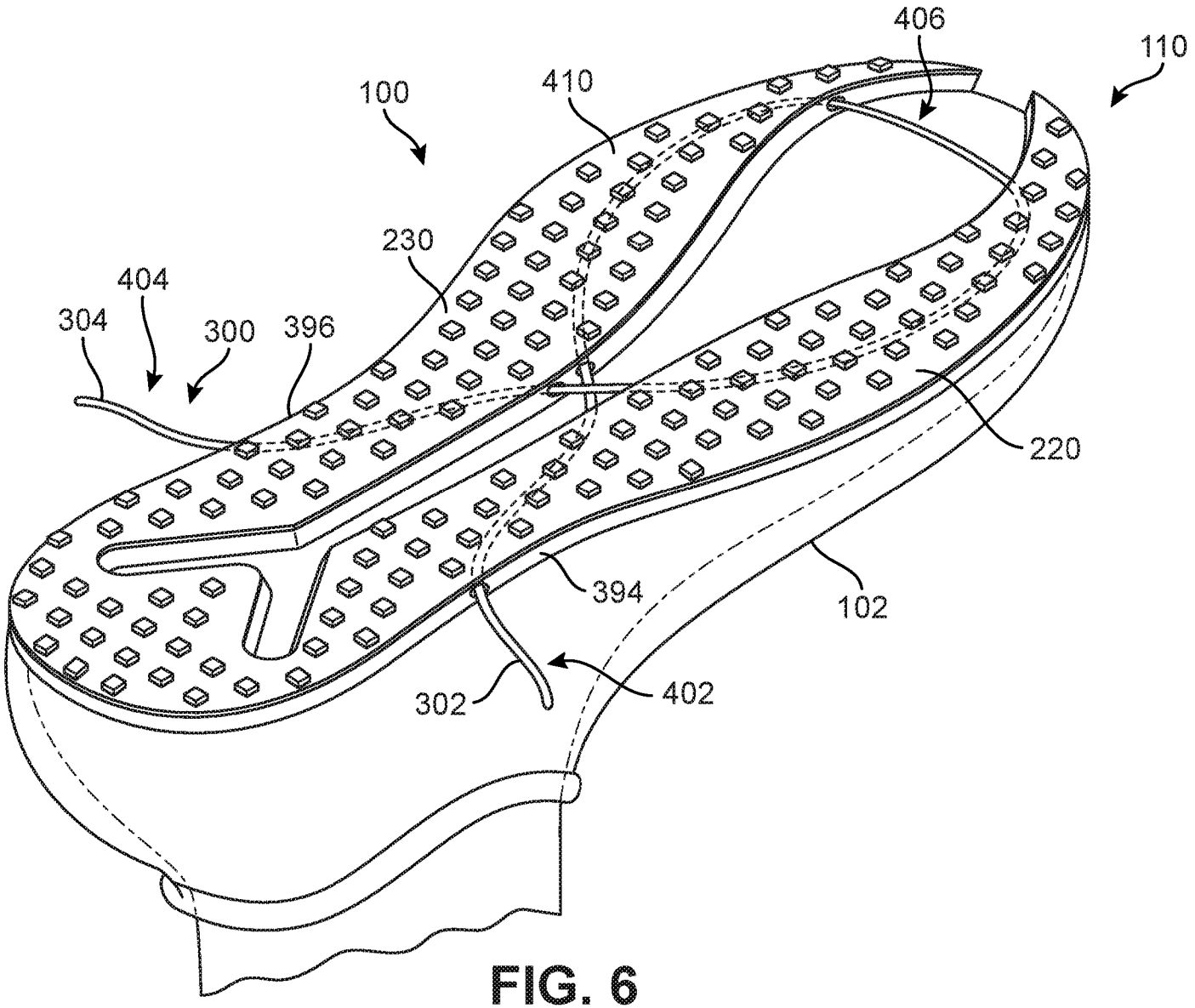
FIG. 6 is an isometric view of a bottom side of an embodiment of an article of footwear with a foot inserted into the article, in which a tensioning member is loose.

FIG. 4 illustrates a schematic isometric view of sole structure 110 as well as an enlarged cross-sectional view taken through a portion of sole structure 110. FIG. 5 illustrates a schematic view of the bottom side of sole structure 110. Referring to FIGS. 4 and 5, gap 200 may extend through one or more portions of sole structure 110. In some embodiments, gap 200 may extend through forefoot portion 10. In other embodiments, gap 200 may extend through midfoot portion 12. In still other embodiments, gap 200 may extend through heel portion 14. In an exemplary embodiment, gap 200 may extend through each of forefoot portion 10, midfoot portion 12 and heel portion 14. In still other embodiments, gap 200 could extend through any combination of forefoot portion 10, midfoot portion 12 and heel portion 14. Moreover, while the exemplary embodiments show gap 200 extending continuously from forefoot portion 10 to heel portion 14, in other embodiments gap 200 may comprise discrete or disjoint portions that are separated along the longitudinal direction.

In some embodiments, a first end portion 202 of the gap 200 extends to a forward most edge 250 of sole structure 110. In some embodiments, first side portion 220 of sole structure 110 and second side portion 230 of sole structure 110 are separated at forward most edge 250 by gap 200. In addition, in some embodiments, a second end portion 204 of gap 200 is spaced apart from rearward most edge 252 of sole structure 110. With this arrangement, first side portion 220 and the second side portion 230 of sole structure 110 may be attached at rearward most edge 252 of sole structure 110.

Although the exemplary embodiment illustrates a configuration in which gap 200 is approximately centered in sole structure 110 about the lateral direction, in other embodiments, gap 200 may be disposed significantly closer to either of a medial side edge or lateral side edge of sole structure 110. Moreover, in still other embodiments, some portions of gap 200 may be disposed closer to one side edge of sole structure 110, while other portions may be disposed closer to an opposing side edge. In such embodiments, gap 200 may curve back and forth through sole structure 110.

A gap can include provisions to accommodate changes in the geometry of a sole structure as the size of the gap contracts under tension. In some embodiments, for example, increased flexibility of adjacent side portions within a heel portion can facilitate contraction of the gap in the forefoot and midfoot portions.

In some embodiments, gap 200 may comprise different portions that separate or split at a common vertex. In some embodiment, gap 200 includes a first gap portion 260 that extends from a first end portion 202 of the gap to a gap vertex portion 270. At gap vertex portion 270, first gap portion 260 may split into a second gap portion 262 and a third gap portion 264. Moreover, first gap portion 260 is primarily disposed in forefoot portion 10 and midfoot portion 12, while second gap portion 262 and third gap portion 264 may be primarily disposed in heel portion 14.

In some embodiments, second gap portion 262 and third gap portion 264 may extend into first side portion 220 and second side portion 230 of sole structure 110. Thus, while first gap portion 260 may be positioned approximately centrally in the lateral direction, especially in midfoot portion 12, second gap portion 262 and third gap portion 264 extend away from the lateral center and towards the sides of sole structure 110.

As seen most clearly in FIG. 5, first gap portion 260 may extend in an approximately longitudinal direction, and may be approximately parallel with longitudinal axis 350. Additionally, second gap portion 262 and third gap portion 264 may be angled with respect to longitudinal axis 350. Specifically, in an exemplary embodiment, second gap portion 262 and third gap portion 264 are oriented in directions that form an angle A1 and an angle A2, respectively, with longitudinal axis 350. In some cases, the values of angle A1 and angle A2 can vary in the range between 0 degrees and 180 degrees. In some cases, the values of angle A1 and angle A2 can vary in the range between 30 and 60 degrees.

For purposes of description, second gap portion 262, third gap portion 264, vertex portion 270 and the adjacent portion of first gap portion 260 may be collectively referred to as split gap portion 280. In some embodiments, split gap portion 280 allows for better flexure between first side portion 220 and second side portion 230 in both forefoot portion 10 and midfoot portion 12, since the width of first side portion 220 and second side portion 230 are minimized at the ends of second gap portion 262 and third gap portion 264. Thus, using the exemplary configuration, split gap portion 280 facilitates lateral flexure of first side portion 220 and second side portion 230.

In different embodiments, the length of gap 200 may vary. For purposes of characterizing the length of gap 200 relative to the length of sole structure 110, various exemplary lengths are indicated in FIG. 5. For example, sole structure 110 has a length L1, while gap 200 has a length L2. In some embodiments, the ratio of length L2 to length L1 is greater than 0.5 (i.e., length L2 is at least 50% of length L1). In other embodiments, the ratio of length L2 to length L1 is greater than 0.75 (i.e., length L2 is at least 75% of length L1). Of course, in other embodiments, the ratio of length L2 to length L1 may be less than 0.5. The use of an elongated gap that extends through a majority of the length of the sole structure helps improve the ability of the gap to contract in size. In particular, in the exemplary embodiment, gap 200 may more easily contract at midfoot portion 12 and forefoot portion 10 with the flexure point (e.g., the location where first side portion 220 and second side portion 230 are attached) disposed in heel portion 14, than if the flexure point were located substantially forwards of heel portion 14.

In different embodiments, the width of gap 200 may vary. In some embodiments, different portions of gap 200 may be associated with different widths. For example, in some embodiments, first gap portion 260 of gap 200 has a maximum width of W1 in forefoot portion 10 and a maximum width W2 in midfoot portion 12. In some cases, width W1 is substantially greater than width W2. Additionally, in some embodiments, second gap portion 262 has a maximum width W3 and third gap portion 264 has a maximum width W4. In some cases, width W3 and width W4 may be approximately equal. Moreover, in some embodiments, width W2, width W3 and width W4 may be approximately equal. In some embodiments, the ratio of width W2 to width W3 may be closer to 1 than the ratio of width W2 to width W1. Likewise, in some embodiments, the ration of width W2 to width W3 may be closer to 1 than the ratio of width W2 to width W1.

In some embodiments, the width of gap 200 in forefoot portion 10 varies in a non-linear manner. As seen in FIG. 5, the width of gap 200 in forefoot portion 10 varies from width W6 at forward most edge 250 of sole structure 110, to a width W7 at a portion adjacent to midfoot portion 12. Moreover, the maximum width W1 of forefoot portion 10 is greater than both width W6 and width W7. Thus, the width is seen to increase and then decrease again as one moves from forward most edge 250 of forefoot portion 10 towards midfoot portion 12 (i.e., in a rearward direction along forefoot portion 10). Additionally, in some embodiments, the width changes relatively smoothly. This arrangement may give a first inner side wall 390 of first side portion 220 an approximately concave geometry in forefoot portion 10. Likewise, this arrangement may give second inner side wall 392 of second side portion 230 an approximately concave geometry in forefoot portion 10. By varying the width of gap 200 in various locations, especially within and between forefoot portion 10 and/or midfoot portion 12, the comfort and fit of article 100 can be adjusted.

Referring now to FIGS. 3-5, as previously discussed article 100 includes a tensioning member 300 for tensioning sole structure 110 and adjusting the size of gap 200. In some embodiments, tensioning member 300 includes a first end portion 302, a second end portion 304 and an intermediate portion 306, which is disposed between first end portion 302 and second end portion 304.

Tensioning member 300 may include portions that extend within or through sole structure 110, as well as portions that are external to sole structure 110. In some embodiments, sole structure 110 may therefore include provisions for receiving portions of tensioning member 300. In some embodiments, one or more components of sole structure 110 can include channels, cavities, passages or other provisions for receiving portions of tensioning member 300.

Referring to FIGS. 3 and 4, in some embodiments, midsole 120 may be configured with a plurality of internal channels 370. In some embodiments, plurality of internal channels 370 may include first internal channel 371, second internal channel 372, third internal channel 373 and fourth internal channel 374. First internal channel 371 may extend between opening 381 and opening 382 on a first inner sidewall 390 of first side portion 220. Likewise, second internal channel 372 may extend between first opening 383 and second opening 384 on second inner sidewall 392 of second side portion 230. Additionally, third internal channel 373 may extend from third opening 385 on first inner sidewall 390 to fourth opening 386 of first outer sidewall 394 of first side portion 220. Likewise, fourth internal channel 374 may extend from fifth opening 387 on second inner sidewall 392 to sixth opening 388 of second outer sidewall 396 of second side portion 230.

As seen in the cross-sectional view of FIG. 4, in an exemplary embodiment, one or more channels may be lined with tubes. In particular, for example, first internal channel 371 may be lined with tube 397. Also, second internal channel 372 may be lined with tube 398. Similarly, the remaining channels may be lined with tubes. The tubes may be provided to house tensioning member 300 and facilitate smooth travel of tensioning member 300 through each channel, thereby reducing friction. However, in other embodiments, one or more channels may not include tubes and can receive and directly contact tensioning member 300.

In an exemplary embodiment, each channel is an enclosed cavity within midsole 120. However, in other embodiments one or more channels could be open at either an inner surface or an outer surface of midsole 120. In other words, in some embodiments, tensioning member 300 could be received into recesses within an exterior surface of midsole 120. In still other embodiments, outsole 130 could include provisions, such as channels, recesses or other passages, for receiving tensioning member 300.

As best understood with reference to FIGS. 2 and 3, tensioning member 300 may extend through plurality of channels 370 within sole structure 110. The approximate location of tensioning member 300 within these channels is depicted in phantom in FIG. 2, while the channel locations are shown in phantom in FIG. 3. Starting at first end portion 302, a second segment 320 of tensioning member 300 extends through first side portion 220 (within third channel 373), a third segment 322 of tensioning member 300 crosses gap 200 and then a fourth segment 324 of tensioning member 300 extends into second side portion 230 (through second channel 372). From second side portion 230, a first segment 310 extends across gap 200 and a fifth segment 326 extends through first side portion 220 (within first channel 371). Upon exiting first channel 371, a sixth segment 328 of tensioning member 300 extends across gap 200 and enters second side portion 230 as seventh segment 329, until exiting second side portion 230 and ending at second end portion 304.

In the exemplary embodiment, sixth segment 328 of tensioning member 300 crosses over third segment 322 of tensioning member 300 at gap 200. However, it is possible that in other embodiments, segments of tensioning member 300 may not cross at gap 200. In some other embodiments, for example, segments of tensioning member 300 could cross within the interior of sole structure 110 (e.g., within intersecting, or vertically separated, channels).

The process of using tensioning member 300 to adjust the fit of article 100 is illustrated in FIGS. 6 through 9. Starting in FIG. 6, no tension is applied to tensioning member 300. This configuration may be useful for inserting a foot into article 100, since the absence of tension in tensioning member 300 allows maximum separation between first side portion 220 and second side portion 230 of sole structure 110.

For purposes of characterizing the operation of sole structure 110, tensioning member 300 may be identified with a first free portion 402, a second free portion 404 and a constrained portion 406, which extends between first free portion 402 and second free portion 404. First free portion 402 is defined as the portion of tensioning member 300 extending from first outer side wall 394 to first end portion 302. Second free portion 404 is defined as the portion of tensioning member 300 extending from second outer side wall 396 to second end portion 304. Constrained portion 406 is defined as the portion between first free portion 402 and second free portion 404, and generally is constrained within an outer periphery 410 of sole structure 110.

It will be understood that as first end portion 302 and/or second end portion 304 are pulled away from sole structure 110, the lengths of first free portion 402 and second free portion 404 may change (e.g., increase as more of tensioning member 300 is pulled out of sole structure 110). Moreover, as the total length of first free portion 402 and second free portion 404 increases, the length of constrained portion 406 decreases in a corresponding manner, as the total length of tensioning member 300 will be approximately conserved.

Figure 7:
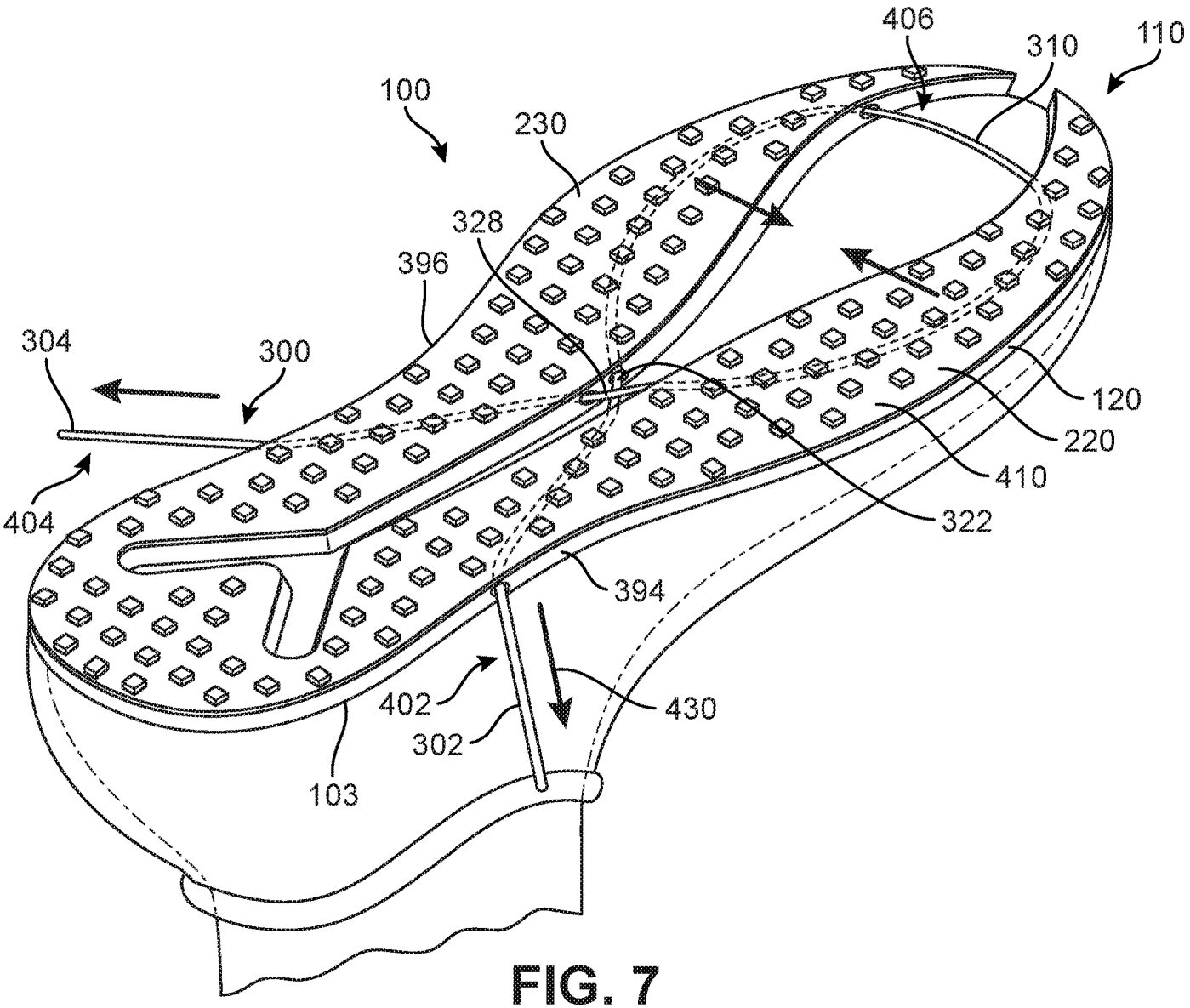
FIG. 7 is an isometric view of the article of footwear of FIG. 6, in which the tensioning member is tensioned.

Referring to FIG. 7, a first tension 430 is applied to tensioning member 300 at first end portion 302 and second end portion 304. This acts to pull more of tensioning member 300 from first outer side wall 394 and second outer side wall 396, which increases the lengths of first free portion 402 and second free portion 404. Correspondingly, the length of constrained portion 406 is decreased. Because the lengths of channels inside midsole 120 are approximately fixed in length, the decrease in the length of constrained portion 406 must be made up for by a reduced length for first segment 310, third segment 322 and sixth segment 328. In other words, as constrained portion 406 decreases in length it acts to contract gap 200, thereby pulling first side portion 220 and second side portion 230 closer together.

Figure 8:
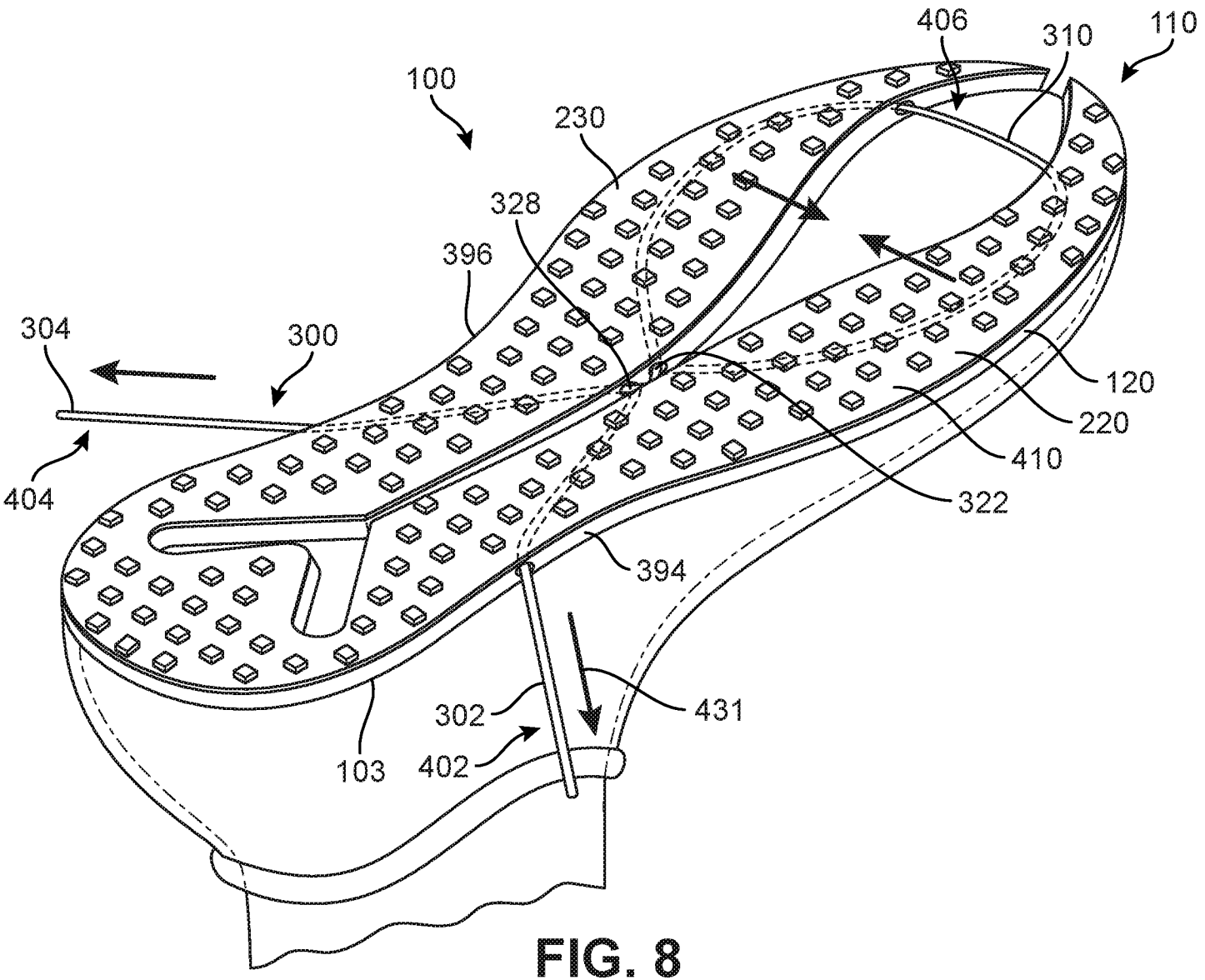
FIG. 8 is an isometric view of the article of footwear of FIG. 6, in which the tensioning member is tensioned.
Figure 9:
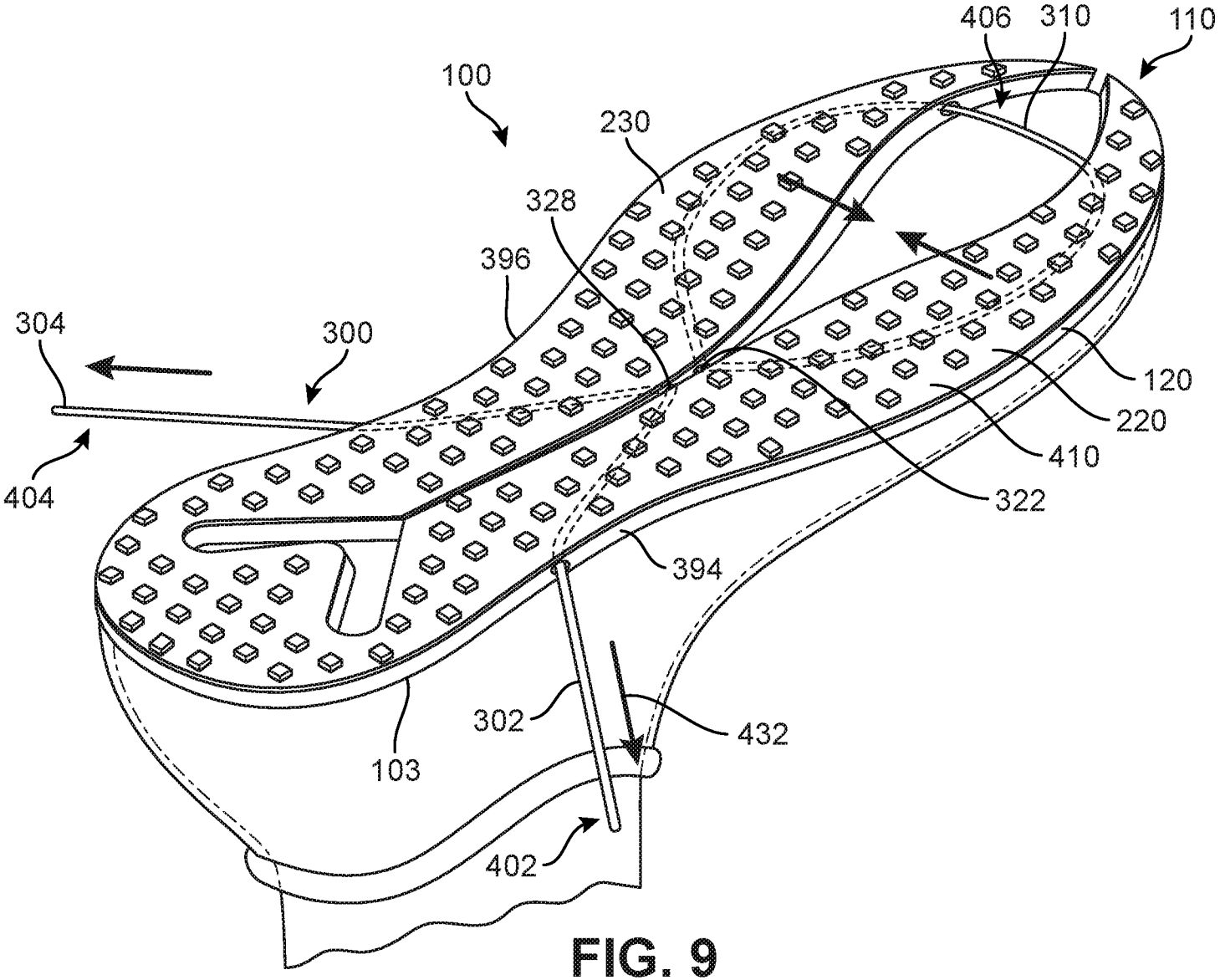
FIG. 9 is an isometric view of the article of footwear of FIG. 6, in which the tensioning member is tensioned.

FIGS. 8 and 9 illustrate sequential configurations in which the tension applied to first end portion 302 and second end portion 304 of tensioning member 300 is increased, which further acts to contract sole structure 110 in a lateral direction as gap 200 decreases in width. In this case, a second tension 431 is applied in FIG. 8 and a third tension 432 is applied in FIG. 9, with second tension 431 and third tension 432 representing incremental increases in tension from first tension 430 (shown in FIG. 7). With increasing tension, first free portion 402 and second free portion 404 increase in length, resulting in a decreasing length for constrained portion 406, thereby contracting first side portion 220 and second side portion 230 closer together.

Moreover, as seen in comparing FIGS. 6 through 9, as the width of sole structure 110 is decreased (i.e., as gap 200 is contracted), upper 102 is pulled tighter against a foot. Specifically, as sole structure 110 contracts in the widthwise direction, the outer periphery of 410 of sole structure 110 pulls on the lower periphery 103 of upper 102. Thus, upper 102 is pulled tighter against the foot as the volume of the interior cavity decreases.

FIGS. 13-20 illustrate additional embodiments of an article of footwear 100 that include sole structures 110 configured with a gap 200 located between first and second side portions 940, 950 of the midsole 120 and a tensioning member 300 for contracting the gap 200 to tighten the sole structure 110 as described herein. In the embodiments of FIGS. 13-20, the gap 200 is located entirely within the midsole 120, and the outsole 130 covers the entire bottom of the article 100. The outsole 130 completely covers a bottom side the gap 200 in this configuration, such that the gap 200 may be defined as a cavity or partial cavity within the sole structure 110. The configurations of FIGS. 13-20 may also be used in connection with an embodiment where the gap 200 extends partially or completely through the outsole 130, and thus, the gap 200 may be considered to extend through at least the midsole 120 of the sole structure 110. In the embodiments of FIGS. 13-20, the gap 200 is shown extending through the entire thickness of the midsole 120. However, it is understood that in other embodiments, the gap 200 may extend through only a portion of the thickness of the midsole 120 as described elsewhere herein, either by extending through a top portion or a bottom portion of the midsole 120. It is understood that the embodiments of FIGS. 13-20 are generally described herein with respect to their differences from the embodiments already described herein, and that components and features that are similar to those already described will not be described again herein for the sake of brevity.

The gap 200 in the embodiments of FIGS. 13-20 extends through portions of the forefoot portion 10, the midfoot portion 12, and the heel portion 14, and as described herein, in other embodiments, gap 200 could extend through any combination of forefoot portion 10, midfoot portion 12 and heel portion 14. The gap 200 in the embodiments of FIGS. 13-17 and 19-20 has a substantially constant width along the entire length of the gap 200. In other embodiments, the gap 200 may have a width that varies, such as according to various embodiments described herein. For example, the embodiment of FIG. 18 has a gap 200 that is wider at the forefoot portion 10 and narrower at the midfoot portion 12, with a split gap portion 280 at least partially disposed in the heel portion 14, similar to the gap 200 illustrated in other embodiments herein. It is understood that the split gap portion 280 may include any other structures described herein to create the split gap portion, and that some of those structures are indicated by common reference numbers in FIG. 18 despite not not being re-described herein with respect to this embodiment for the sake of brevity. Additionally, the gap 200 is entirely surrounded by the misole 120 in the embodiments of FIGS. 13-20, such that the first and second side portions 940, 950 are joined together at the the forward most edge 250 and the rearward most edge 252 of the sole structure 110. However, in another embodiment, the gap 200 may extend to one or more outermost edges of the midsole 120, including the forwardmost and/or the rearwardmost edges 250, 252.

Figure 19:
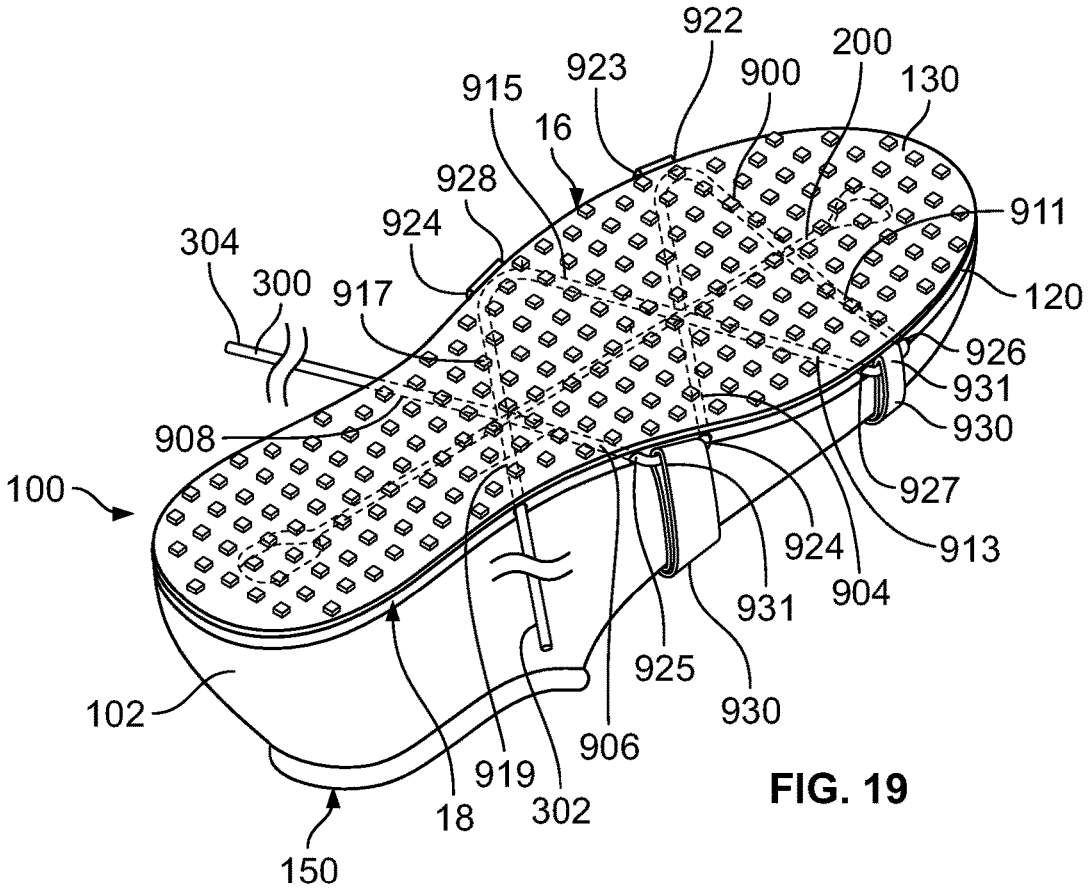
FIG. 19 is a schematic isometric view of a bottom side of an embodiment of an article of footwear.
Figure 20:
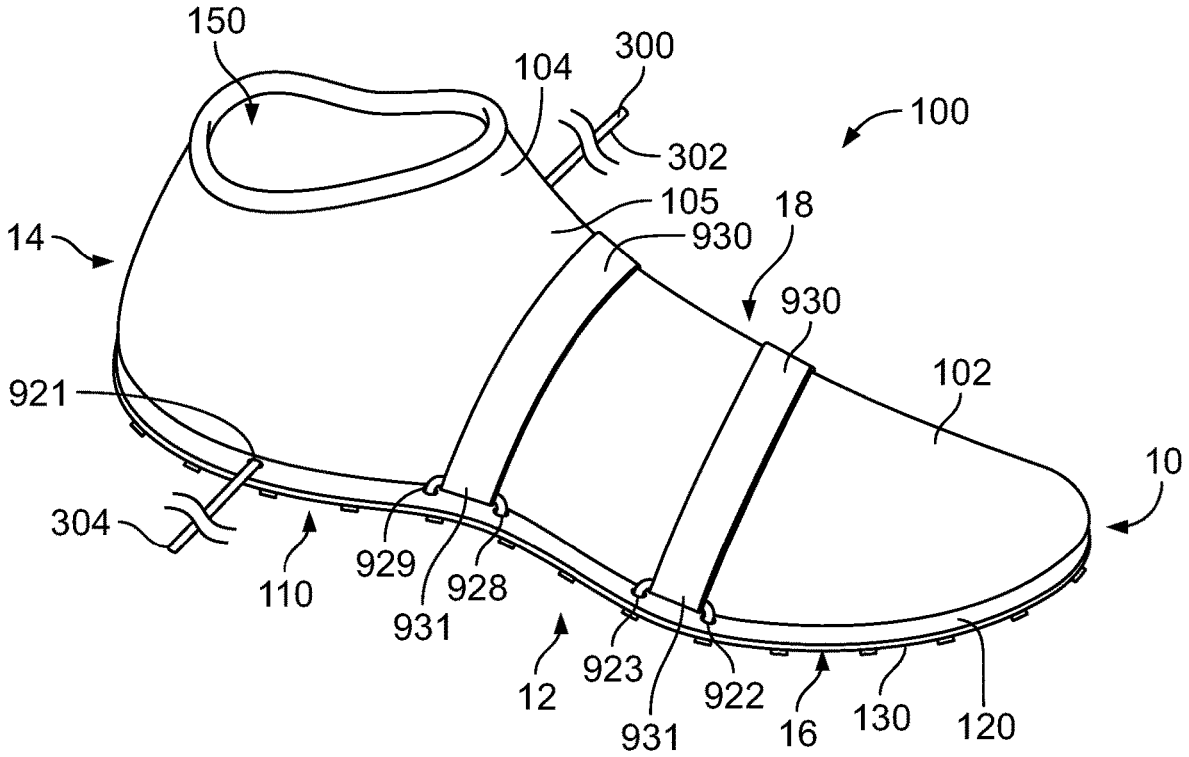
FIG. 20 is a schematic isometric view of a top side of the article of footwear of FIG. 19.

The tensioning member 300 is configured to pass through the sole structure 110 as similarly described above with respect to other embodiments. In the embodiments of FIGS. 13-20, the midsole 120 is provided with a plurality of internal channels 370, and the tensioning member 300 passes through the channels 370. The channels 370 include a first internal channel 900 extending laterally from a first opening 901 on a first inner sidewall 390 of the first side portion 940 near the forward most edge 250 toward the lateral side 16 of the article 100, a second internal channel 902 extending from the lateral end of the first internal channel 900 toward the center and rear of the article 100 and to a second opening 903 in the first inner sidewall 390 of the first side portion 940. A third inner channel 904 extends from a third opening 905 on the first inner sidewall 392 of the second side portion 950, rearward and toward the medial side 18 of the article 100, a fourth internal channel 906 extends from the medial end of the third inner channel 904 toward the center and rear of the article 100 and to a fourth opening 907 on the first inner sidewall 392 of the second side portion 950. A fifth internal channel 908 extends from a fifth opening 909 on the first inner sidewall 390 of the first side portion 940 to a sixth opening 910 on the lateral side 16 of the article 100. The channels 370 further include a sixth internal channel 911 extending laterally from a seventh opening 912 on the first inner sidewall 390 of the first side portion 940 near the forward most edge 250 toward the medial side 18 of the article 100, a seventh internal channel 913 extending from the medial end of the sixth internal channel 911 toward the center and rear of the article 100 and to an eighth opening 914 in the first inner sidewall 392 of the second side portion 950. An eighth inner channel 915 extends from a ninth opening 916 on the first inner sidewall 390 of the first side portion 940, rearward and toward the lateral side 16, a ninth internal channel 917 extends from the lateral end of the eighth inner channel 915 toward the center and rear of the article 100 and to a tenth opening 918 on the first inner sidewall 390 of the first side portion 940. A tenth internal channel 919 extends from an eleventh opening 920 on the first inner sidewall 392 of the second side portion 950 to a twelfth opening 921 on the medial side 18 of the article 100. The channels 370 in the embodiments of FIGS. 13-18 are configured such that the tensioning member 300 does not extend outside the peripheral boundary of the midsole 120 at any point other than the openings 910 and 921 where the end portions 302, 304 protrude. The embodiment of FIGS. 19-20 is differently configured, as described below. In other embodiments, the configuration of the channels 370 and openings within the midsole 120 may be different, including having a configuration as shown in FIGS. 1-12.

Figure 13:
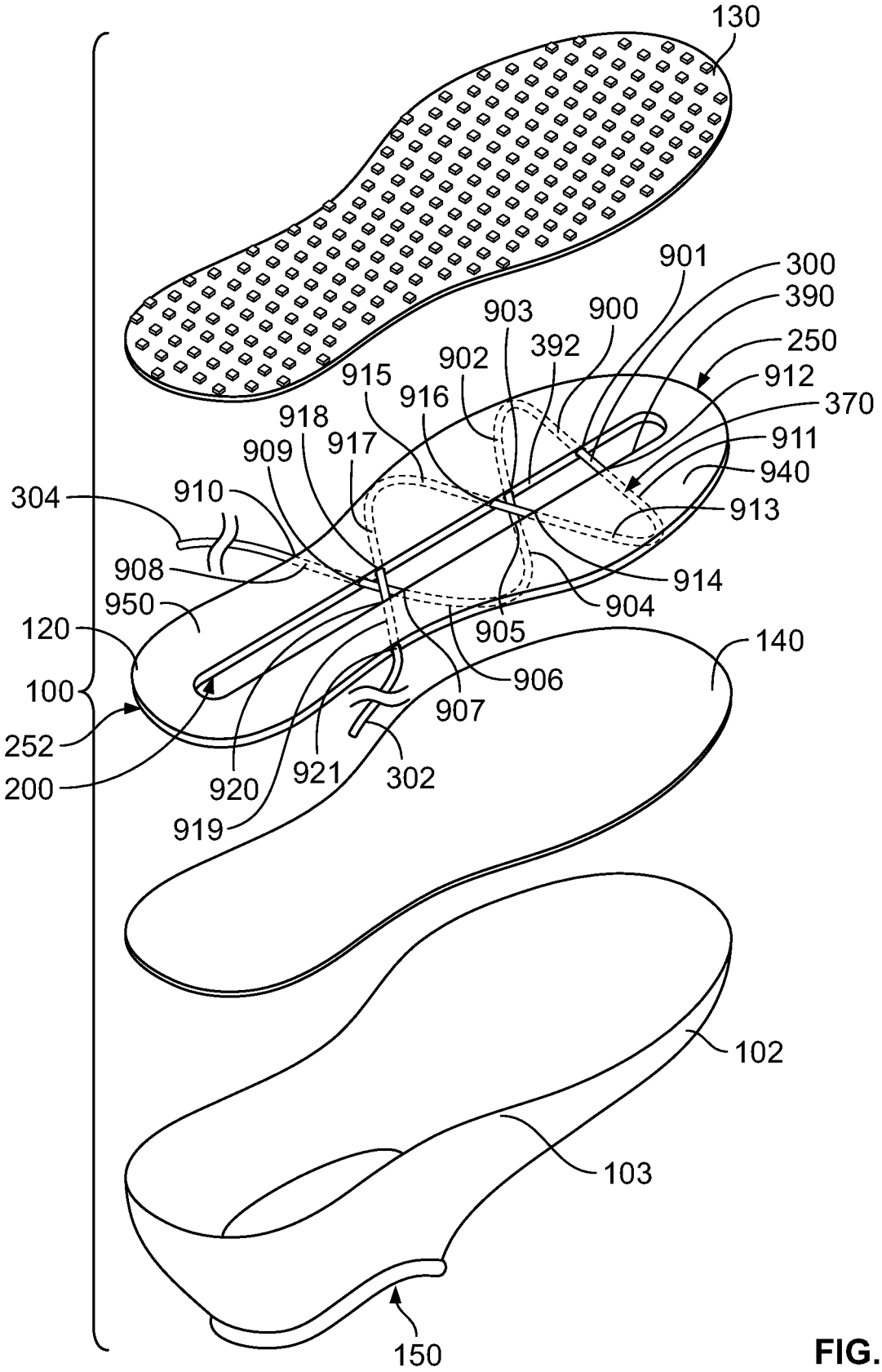
FIG. 13 is a schematic isometric exploded view of an embodiment of an article of footwear.
Figure 14:
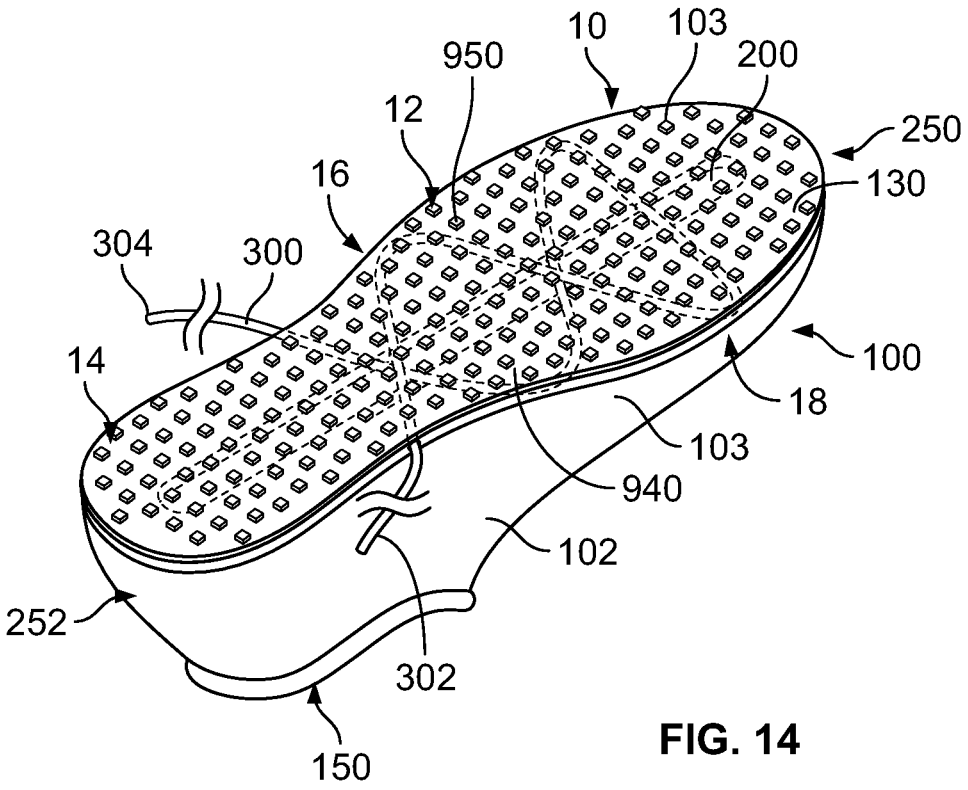
FIG. 14 is a schematic isometric view of a bottom side of the article of footwear of FIG. 13.
Figure 16:
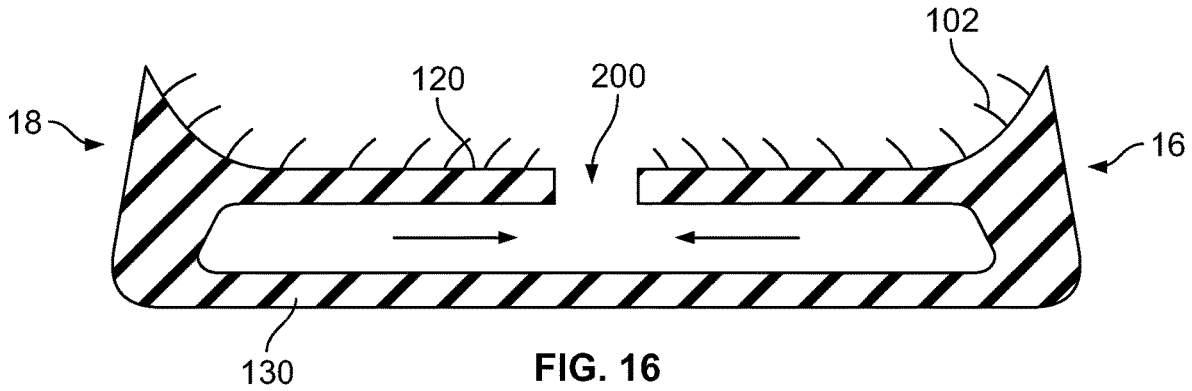
FIG. 16 is a schematic cross-sectional view of the article of footwear of FIG. 14.
Figure 17:
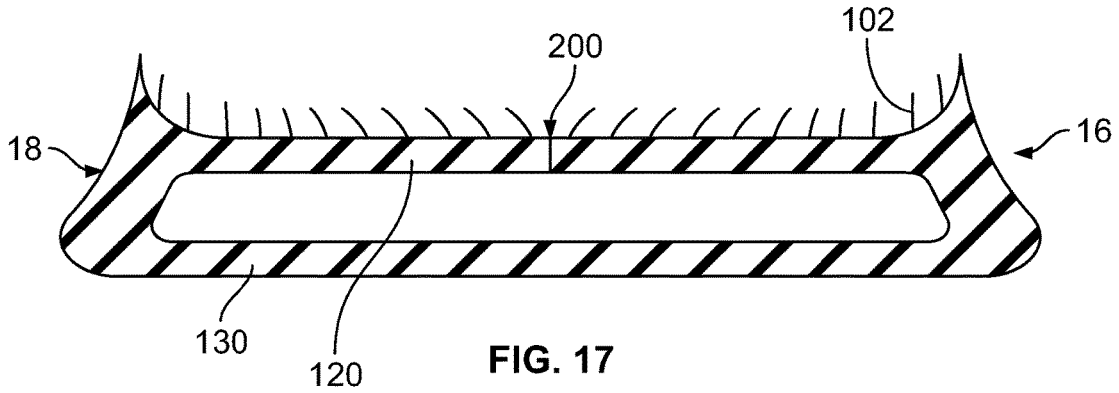
FIG. 17 is a schematic cross-sectional view of the article of footwear of FIG. 14, in which the tensioning member is tensioned.
Figure 18:
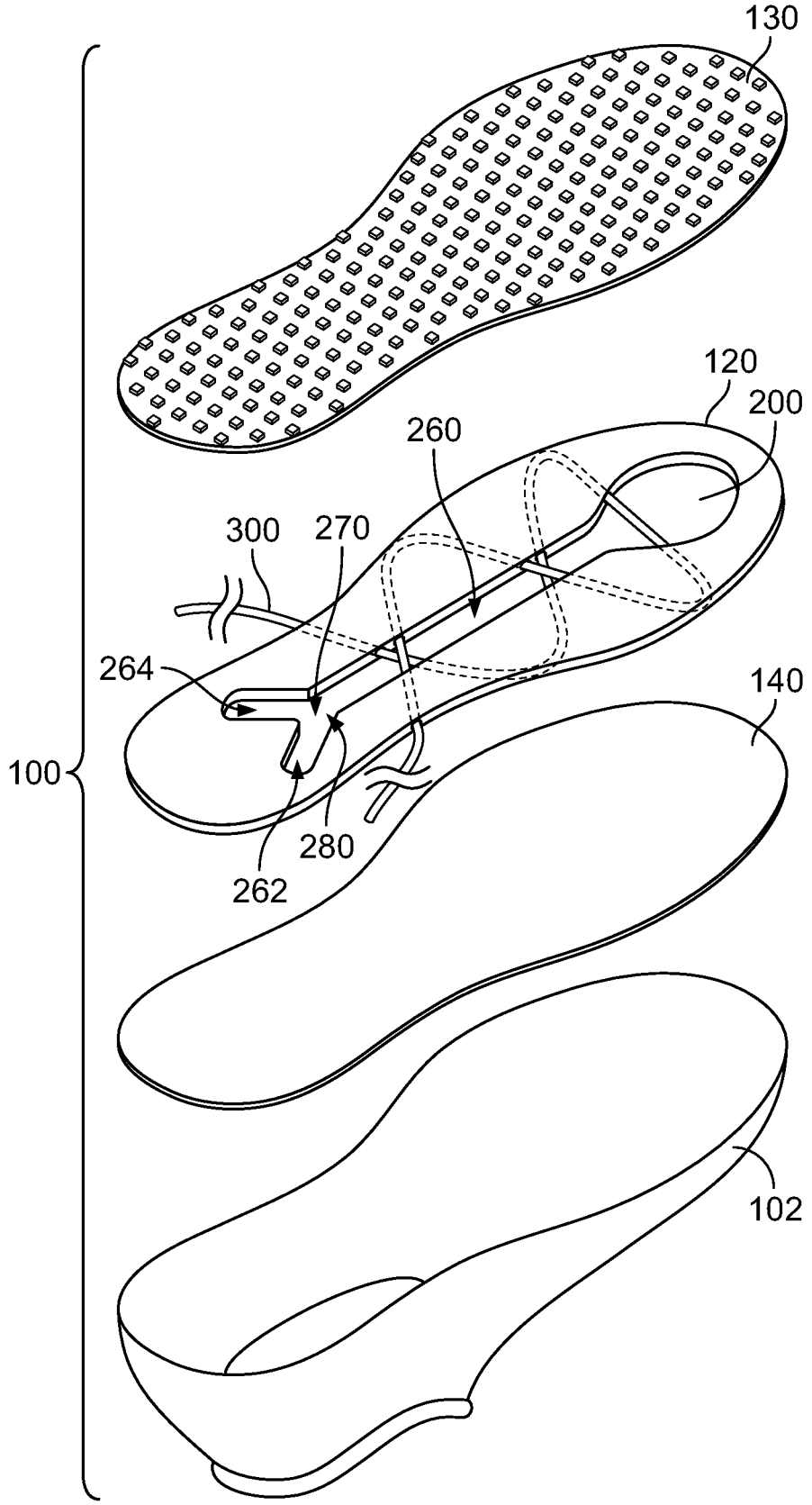
FIG. 18 is a schematic isometric exploded view of an embodiment of an article of footwear.

The tensioning member 300 in the embodiments of FIGS. 13-18 is configured to cross the gap 200 multiple times along the path through the midsole 120. As shown in FIGS. 13 and 18, the tensioning member 300 crosses the gap 200 five times along the path, including two cris-crossing passes.

Figure 15:
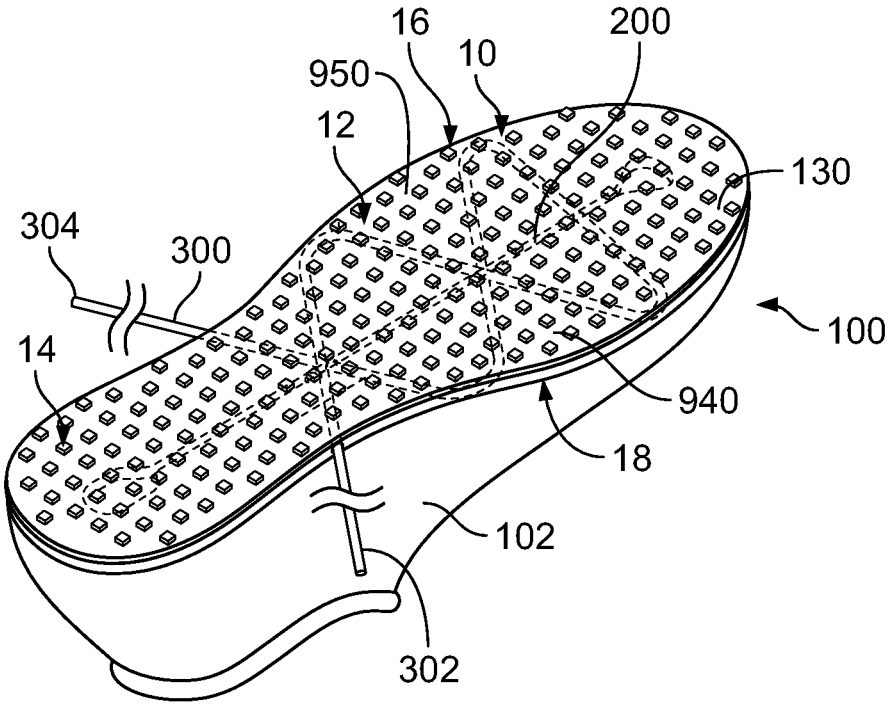
FIG. 15 is an isometric view of the article of footwear of FIG. 14, in which the tensioning member is tensioned.

As shown in FIG. 15, the tensioning member 300 can be tensioned in order to bring the first and second side portions 940, 950 closer together, thereby contracting the gap 200 and tightening the sole structure 110. This action is shown schematically in FIGS. 16-17, and this action also tightens the upper 102 indirectly, as described elsewhere herein. As shown in FIGS. 16-17, the tightening in the sole structure 110 may occur primarily by contraction at the top of the sole structure, rather than contraction of the outsole 130, in an embodiment where the outsole 130 covers the gap 200. The sole structure 110 in FIG. 18 can be tightened in the same manner. The tensioning member 300 can be tightened using any technique described herein with respect to the embodiments of FIGS. 1-12. It is understood that the article 100 may include multiple tensioning members 300 arranged to tighten the sole structure 110 according to aspects described herein.

FIGS. 19-20 illustrate an additional embodiment in which the tensioning member 300 is capable of tightening the upper 102 indirectly though tightening of the sole structure 110 as described herein, as well as directly through the use of straps 930 that wrap around at least a portion of the upper 102. As shown in FIG. 19, the channels 370 in the midsole 120 are configured to include peripheral openings 922-929 around the peripheral edges of the midsole 120, to permit the tensioning member 300 to engage the straps 930 at the peripheral edges of the midsole 120 to tighten the straps 930. The peripheral openings in the embodiment of FIGS. 19-20 are located along the lateral and medial sides 16, 18. These peripheral openings 922-929 include a first peripheral opening 922 at the lateral end of the first internal channel 900, a second peripheral opening 923 at the lateral end of the second internal channel 902, a third peripheral opening 924 at the medial end of the third internal channel 904, a fourth peripheral opening 925 at the medial end of the fourth internal channel 906, a fifth peripheral opening 926 at the medial end of the sixth internal channel 911, a sixth peripheral opening 927 at the medial end of the seventh internal channel 913, a seventh peripheral opening 928 at the lateral end of the eighth internal channel 915, and an eighth peripheral opening 929 at the lateral end of the ninth internal channel 917. These peripheral openings 922-929 are arranged in pairs, such that the a portion of the tensioning member 300 is positioned outside the periphery of the midsole 120 between the peripheral openings of each pair and engages one of the straps 930 at that location. In another embodiment, portions of the straps 930 or connecting structure connected to the straps 930 may extend into the midsole 120 to engage the tensioning member 300, and it is understood that larger peripheral openings 922-929 may be necessary for such a configuration. For example, pairs of peripheral openings such as 922-923 could be combined into a single slot to receive a portion of the strap 930.

The tensioning member 300 engages the straps 930 in the embodiment of FIGS. 19-20 by extending through loops or openings 931 in the ends of the straps 930. The straps 300 may further include removable structure, such as a hook-and-loop structure, to permit disconnection and removal of the straps 930 without removing the tensioning member 300. In other embodiments, the straps 930 may have a different connection structure for connection to the tensioning member 300. As shown in FIGS. 19-20, the article 100 includes two straps 930. One strap 930 extends across the top of the upper 102 at the forefoot portion 10 and connects to the tensioning member 300 between one pair of peripheral openings 922-923 on the lateral side 16 and another pair of peripheral openings 926-927 on the medial side 18. The other strap 930 extends across the top of the upper 102 at the midfoot portion 12 and connects to the tensioning member 300 between one pair of peripheral openings 928-929 on the lateral side 16 and another pair of peripheral openings 924-925 on the medial side 18. The straps 930 are shown as being positioned outside the upper 102 in FIG. 20, although the upper 102 may have structure for engagement and/or connection to the straps 930 in other embodiments. For example, the straps 930 could extend through openings, loops, and/or channels that extend through portions of the upper 102, including potentially a channel that places all or substantially all of each strap 930 within the upper 120. As another example, the straps 930 could be fixed to the upper 102 at certain portions along their lengths, such as by sewing or adhesive. Other configurations are contemplated as well.

As shown in FIG. 19, when the tensioning member 300 is tightened to contract the midsole 120 as described above, the tensioning member 300 also pulls both ends of each of the straps 930. This action causes the straps 930 to constrict the upper 102, thereby tightening the upper 102 around the user's foot directly, in addition to the indirect tightening caused by contraction of the sole structure 110 as described above. The straps 930 may have appropriate elasticity to provide a comfortable and consistent tightening process. The configuration of the straps 930 and the peripheral openings 922-929 may be different in other embodiments, in which potentially a greater number of straps 930 may be used. In a further embodiment, an article of footwear 100 as shown and described in FIGS. 1-12 may be outfitted with straps 930 as illustrated in FIGS. 19-20.

The configuration of sole structure 110, including an adjustable gap and a tensioning member, provides a means for locating a tightening system for article 100 within sole structure 110, rather than within upper 102. Such an arrangement may allow for adjustable fit articles that have substantially smooth outer surfaces along the upper (e.g., smooth insteps) due to the lack of fasteners on the upper. This may allow for improved precision in various activities such as kicking or other activities where it may be desirable to have fasteners located away from the conventional locations along or near the instep of the upper. The straps 930 may be provided with a relatively thin and flat profile in order to not substantially change the smoothness of the outer surface of the upper.

Further, the configuration described here provides a fastening system that is integrated into the existing structures of an article, rather than being located on-top of, or external to those structures. In particular, the exemplary embodiments illustrate a system where a tensioning member is housed within channels integrated into the interior of the sole structure, thereby reducing the need for structures that extend out of the exterior surface of the article.

Figure 10:
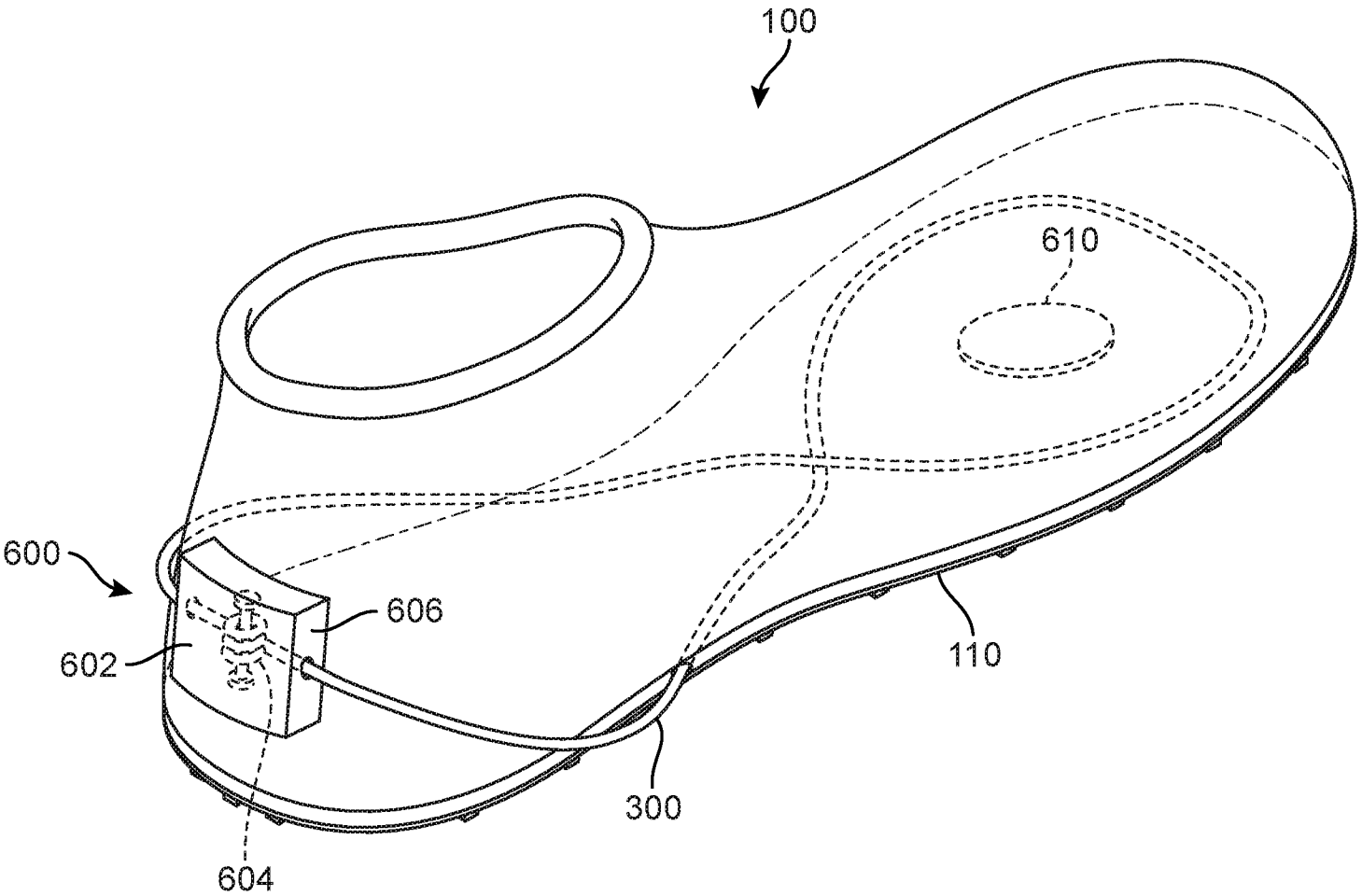
FIG. 10 is an isometric view of an embodiment of footwear, including a tensioning device.

FIG. 10 illustrates a schematic view of article 100 that includes some components of an automatic tensioning system 600, also referred to simply as system 600. The term "automatic tensioning system" refers to one or more components that facilitate tightening (or loosening) an article automatically. In addition to the provisions discussed above, including sole structure 110 with a contracting gap 200, and tensioning member 300, exemplary embodiments of automatic tensioning system 600 may also include a tensioning device 602, and one or more sensors.

In the exemplary configuration shown in FIG. 10, tensioning device 602 may comprise a winding spool 604 (depicted schematically) that is housed within outer covering 606. Using this arrangement, end portions of tensioning member 300 may be wound onto spool 604 to increase tension. As discussed in further detail below, a motorized winding system may facilitate automatic tensioning that doesn't require a user to manually wind tensioning member 300. However, in other embodiments, any other provisions for tensioning a cable, lace, thread or similar tensioning member or element could be used. An exemplary tensioning system that uses a motorized spool to automatically tension laces or similar tensioning members, and which may be used in some embodiments, is disclosed in Beers, U.S. Patent Application Publication Number 2014/0070042 published on Mar. 13, 2014, and titled "Motorized Tensioning System with Sensors", the entirety being incorporated by reference herein.

Embodiments can also include one or more sensors. In some embodiments, article 100 is associated with a sensor 620. In some embodiments, sensor 620 may be capable of detecting pressure and/or forces, such as pressures and/or forces resulting from contact with a ground surface. Some embodiments may use one or more of the sensors, features, methods, systems and/or components disclosed in the following documents: Case et al., U.S. Pat. No. 8,112,251, issued Feb. 7, 2012; Riley et al., U.S. Pat. No. 7,771,320, issued Aug. 10, 2010; Darley et al., U.S. Pat. No. 7,428,471, issued Sep. 23, 2008; Amos et al., U.S. Patent Application Publication Number 2012/0291564, published Nov. 22, 2012; Schrock et al., U.S. Patent Application Publication Number 2012/0291563, published Nov. 22, 2012; Meschter et al., U.S. Patent Application Publication Number 2012/0251079, published Oct. 4, 2012; Molyneux et al., U.S. Patent Application Publication Number 2012/0234111, published Sep. 20, 2012; Case et al., U.S. Patent Application Publication Number 2012/0078396, published Mar. 29, 2012; Nurse et al., U.S. Patent Application Publication Number 2011/0199393, published Aug. 18, 2011; Hoffman et al., U.S. Patent Application Publication Number 2011/0032105, published Feb. 10, 2011; Schrock et al., U.S. Patent Application Publication Number 2010/0063778, published Mar. 11, 2010; Shum, U.S. Patent Application Publication Number 2007/0021269, published Jan. 25, 2007; Schrock et al., U.S. Patent Application Publication Number 2013/0213147, published on Aug. 22, 2013 titled "Footwear Having Sensor System"; Schrock et al., U.S. Patent Application Publication Number 2013/0213144, published on Aug. 22, 2013, titled "Footwear Having Sensor System", where the entirety of each document is incorporated by reference.

Figure 11:
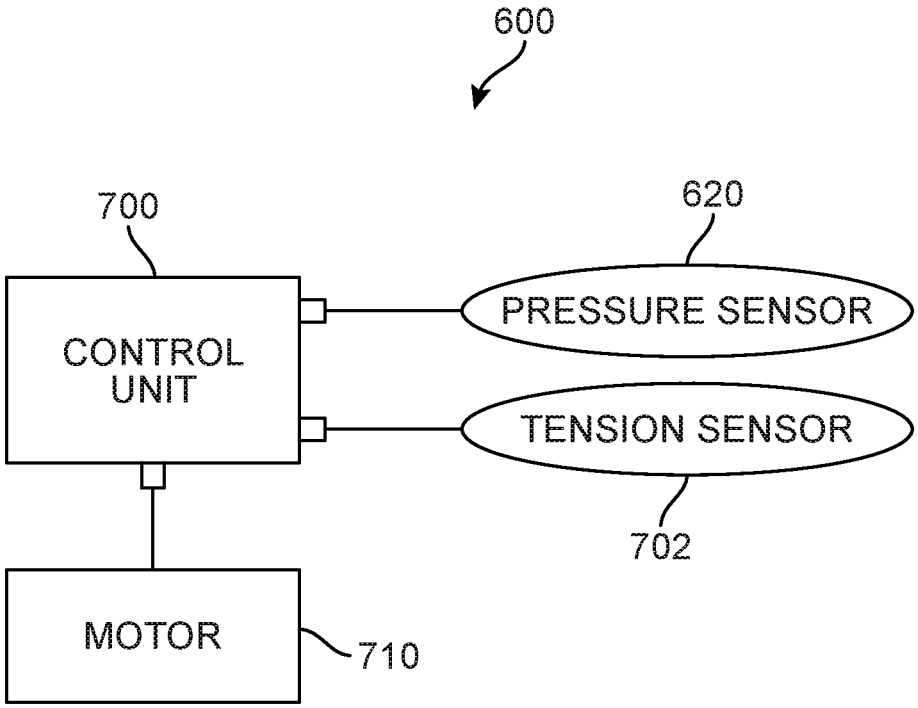
FIG. 11 is a schematic view of an embodiment of some components of an automatic tensioning system.

FIG. 11 illustrates a schematic configuration for some electrical components of automatic tensioning system 600. In this case, a control unit 700 may be in communication with one or more components, including, for example, sensor 620, which may be capable of detecting pressure and/or force information. Control unit 700 may also receive information from a tensioning sensor 702. The information received from sensor 620 and tensioning system 702 may be used to operate an electric motor 710, which may power an automated winding mechanism within tensioning device 602. An exemplary process for operating motor 710 in response to received sensory information is discussed in detail below.

Figure 12:
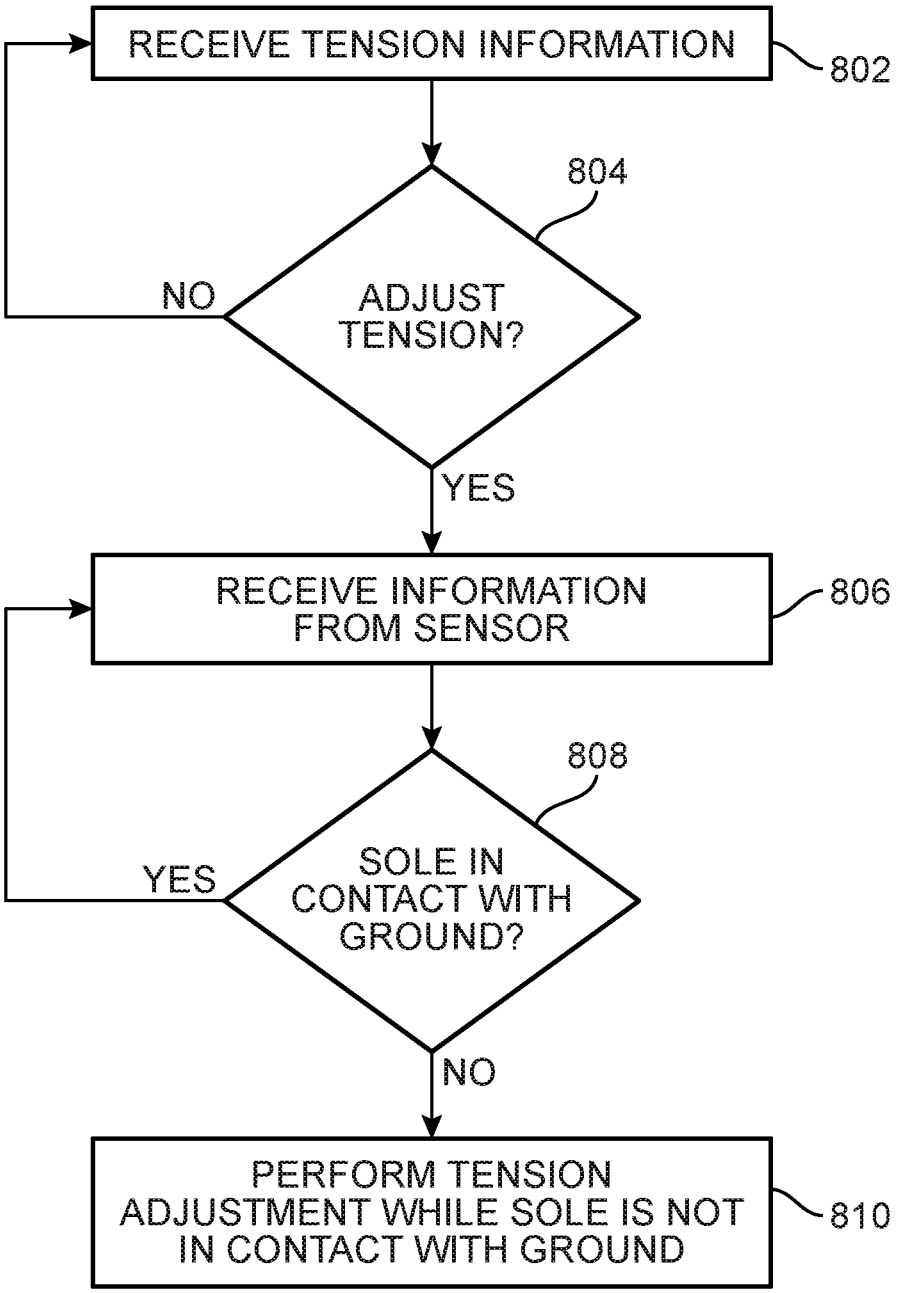
FIG. 12 is a schematic view of a process for automatically controlling tension of a tensioning member in an article of footwear, according to an embodiment.

FIG. 12 illustrates an exemplary process for operating an automatic tensioning system, according to an embodiment. The process, including various steps and/or sub-processes, may be performed by automatic tensioning system 600, by individual components of system 600, and/or by other systems external to system 600. Moreover, each of these steps may be optional and may not be included in all embodiments.

In step 802, system 600 may receive tension information. This may be received, for example, from tensioning sensor 702. In some cases, tensioning sensor 702 may be integrated with tensioning device 602 and relays information related to the amount of tension sensed at a spool, or along a section of tensioning member 300 adjacent to the spool.

Next, in step 804, system 600 determines if the tension needs to be adjusted, according to the tension information received from tensioning sensor 702. If no adjustment is needed, system 600 returns to step 802. Otherwise, system 600 proceeds to step 806. At step 806, system 600 may receive information from a sensor, including a pressure or force sensor. According to this information, system 600 determines if the sole is in contact with a ground surface at step 808. If so, system 600 returns to step 806. This is done to avoid attempting to adjust the tension of the sole while frictional forces between the sole and the ground would interfere with attempts to tension the sole.

If during step 808 system 600 determines that the sole is not on the ground, system 600 proceeds to step 810. At step 810, system 600 may perform a tension adjustment (e.g., tightening or loosening a tensioning member) while the sole is not in contact with the ground. This ensures that tension control occurs while there are no frictional forces with the ground present that could interfere with tensioning.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

a forefoot portion, a midfoot portion and a heel portion;

a longitudinal direction extending from the forefoot portion to the heel portion of the article of footwear;

an upper;

a sole structure comprising an outsole and a midsole, wherein the midsole includes openings on a periphery of the midsole on a medial side of the article and openings on the periphery of the midsole on a lateral side of the article, and wherein the sole structure further comprises:

a gap extending through the midsole in the longitudinal direction, wherein the gap separates a first side portion of the midsole from a second side portion of the midsole, wherein the outsole covers a bottom of the gap; and a tensioning member including a first end portion, a second end portion and an intermediate portion, wherein the intermediate portion extends from the first side portion to the second side portion and across the gap, and wherein segments of the tensioning member extend out of the periphery of the midsole through the openings on a lateral side of the midsole and a medial side of the midsole;

a first strap extending across the upper from the medial side of the article at the medial side of the midsole to the lateral side of the article at the lateral side of the midsole, wherein the segments of the tensioning member extending out of the periphery of the midsole engage the first strap, wherein applying tension to the tensioning member: (a) contracts the gap so that the first side portion and the second side portion of the sole structure are moved closer together and (b) tightens the first strap around the upper; and wherein the gap extends through a majority of a length of the sole structure.

2. The article of footwear according to claim 1, further comprising: a second strap extending across the upper from the medial side of the article to the lateral side of the article, wherein the second strap is separate from and spaced apart from the first strap, wherein additional segments of the tensioning member extend out of the periphery of the midsole on the medial side of the midsole and the lateral side of the midsole and engage the second strap, and wherein applying tension to the tensioning member further tightens the second strap around the upper.

3. The article of footwear according to claim 1, further comprising a second strap extending across the upper from the medial side of the article to the lateral side of the article, wherein the second strap is separate from and spaced apart from the first strap, wherein additional segments of the tensioning member extend out of the periphery of the midsole through additional openings on the periphery of the midsole on the medial side of the article and through additional openings on the periphery of the midsole on the lateral side of the article, wherein the additional segments engage the second strap, and wherein applying tension to the tensioning member further tightens the second strap around the upper.

4. The article of footwear according to claim 3, wherein the intermediate portion extends continuously as follows: (a) extends through a first opening of the openings on the medial side of the article to a first location exterior to the midsole, (b) then engages a medial end of the first strap, (c) then extends through a second opening of the openings on the medial side of the article, (d) then extends across the gap, (e) then extends through a first opening of the openings on the lateral side of the article to a second location exterior to the midsole, (f) then engages a lateral end of the second strap, (g) then extends through a second opening of the openings on the lateral side of the article, (h) then extends across the gap, (i) then extends through a third opening of the openings on the medial side of the article to a third location exterior to the midsole, (j) then engages a medial end of the second strap, (k) then extends through a fourth opening of the openings on the medial side of the article, (l) then extends across the gap, (m) then extends through a third opening of the openings on the lateral side of the article to a fourth location exterior to the midsole, (n) then engages a lateral end of the first strap, and (o) then extends through a fourth opening of the openings on the lateral side of the article.

5. The article of footwear according to claim 1, wherein the gap extends through the midsole in the forefoot portion, the midfoot portion, and the heel portion.

6. The article of footwear according to claim 5, wherein the gap extends completely through a thickness of the midsole.

7. The article of footwear according to claim 1, wherein a first end portion of the gap is spaced apart from a forward most edge of the sole structure so that the first side portion and the second side portion of the midsole are attached at the forward most edge of the sole structure.

8. The article of footwear according to claim 7, wherein a second end portion of the gap is spaced apart from a rearward most end of the sole structure so that the first side portion and the second side portion of the midsole are attached at the rearward most edge of the sole structure.

9. The article of footwear according to claim 1, wherein the first side portion and the second side portion of the midsole each includes at least one channel for receiving the tensioning member.

10. The article of footwear according to claim 1, wherein the gap includes a first gap portion that extends from a first end portion of the gap to a gap vertex portion, and wherein the first gap portion splits into a second gap portion and a third gap portion at the gap vertex portion; and wherein the first end portion is disposed in the forefoot portion, wherein the second gap portion is disposed in the heel portion and wherein the third gap portion is disposed in the heel portion.

11. The article of footwear according to claim 10, wherein the first gap portion extends approximately in the longitudinal direction and wherein the second gap portion and the third gap portion are angled with respect to the longitudinal direction.

12. The article of footwear according to claim 11, further comprising a second strap extending across the upper from the medial side of the article to the lateral side of the article, wherein the second strap is separate from and spaced apart from the first strap, wherein additional segments of the tensioning member extend out of the periphery of the midsole through additional openings on the periphery of the midsole on the medial side of the article and through additional openings on the periphery of the midsole on the lateral side of the article, wherein the additional segments engage the second strap, and wherein applying tension to the tensioning member further tightens the second strap around the upper.

13. The article of footwear according to claim 10, wherein the intermediate portion of the tensioning member includes a first segment that extends across the gap in the forefoot portion, a second segment that extends across the gap in the midfoot portion, and a third segment that extends across the gap in the midfoot portion and wherein the third segment crosses over the second segment.

14. The article of footwear according to claim 10, further comprising: a second strap extending across the upper from the medial side of the article to the lateral side of the article, wherein the second strap is separate from and spaced apart from the first strap, wherein additional segments of the tensioning member extend out of the periphery of the midsole on the medial side of the midsole and the lateral side of the midsole and engage the second strap, and wherein applying tension to the tensioning member further tightens the second strap around the upper.

15. An article of footwear, comprising:

a forefoot portion, a midfoot portion and a heel portion;

a longitudinal direction extending from the forefoot portion to the heel portion of the article of footwear;

an upper;

a sole structure including a midsole, the sole structure further including:

a gap extending through the sole structure in the longitudinal direction, wherein the gap extends through at least the midsole and separates a first side portion of the midsole from a second side portion of the midsole; and a tensioning member including a first end portion, a second end portion and an intermediate portion, wherein the intermediate portion extends from the first side portion to the second side portion and across the gap; and a first strap extending across the upper from a medial side of the article at a medial side of the midsole to a lateral side of the article at a lateral side of the midsole, wherein segments of the tensioning member extend out of a periphery of the midsole on the medial side of the midsole and the lateral side of the midsole and engage a first end and a second end of the first strap, respectively;

wherein applying tension to the tensioning member: (a) contracts the gap so that the first side portion and the second side portion of the sole structure are moved closer together, and (b) tightens the first strap around the upper.

16. The article of footwear according to claim 15, wherein a first end of the first strap includes a first loop and a second end of the first strap includes a second loop, and wherein the segments of the tensioning member extending out of the periphery of the midsole extend through the first loop and the second loop.

17. The article of footwear according to claim 15, wherein the midsole includes a first pair of openings on the periphery of the midsole on the medial side of the article and a second pair of openings on the periphery of the midsole on the lateral side of the article, and wherein the segments of the tensioning member extend out of the periphery of the midsole through the first pair of openings and through the second pair of openings.

18. The article of footwear according to claim 15, further comprising a second strap extending across the upper from the medial side of the article to the lateral side of the article, wherein additional segments of the tensioning member extend out of the periphery of the midsole on the medial side of the midsole and the lateral side of the midsole and engage a first end of the second strap and a second end of the second strap, and wherein applying tension to the tensioning member further tightens the second strap around the upper.

19. An article of footwear, comprising:

a forefoot portion, a midfoot portion and a heel portion;

a longitudinal direction extending from the forefoot portion to the heel portion of the article of footwear;

an upper;

a sole structure comprising a midsole, wherein a periphery of the midsole includes: (a) a first opening on a medial side of the article, (b) a second opening on the medial side of the article forward of the first opening, (c) a third opening on the medial side of the article forward of the second opening, (d) a fourth opening on the medial side of the article forward of the third opening, (e) a fifth opening on a lateral side of the article, (f) a sixth opening on the lateral side of the article forward of the fifth opening, (g) a seventh opening on the lateral side of the article forward of the sixth opening, and (h) an eighth opening on the lateral side of the article forward of the seventh opening, and wherein the sole structure further comprises:

a gap extending through the midsole in the longitudinal direction, wherein the gap separates a first side portion of the midsole from a second side portion of the midsole; and a tensioning member including a first end portion, a second end portion and an intermediate portion;

a first strap extending across the upper from the medial side to the lateral side of the article, wherein the first strap has a first end located at a medial peripheral edge of the midsole on the medial side of the article and a second end located at a lateral peripheral edge of the midsole on the lateral side of the article; and a second strap extending across the upper from the medial side to the lateral side of the article, wherein the second strap is separate from and spaced from the first strap, wherein the second strap has a first end located at the medial peripheral edge of the midsole on the medial side of the article and a second end located at the lateral peripheral edge of the midsole on the lateral side of the article, wherein the intermediate portion extends continuously as follows: (a) extends through the first opening and to a first location exterior to the midsole, (b) then engages the first end of the first strap, (c) then extends through the second opening, (d) then extends across the gap, (e) then extends through the seventh opening to a second location exterior to the midsole, (f) then engages the second end of the second strap, (g) then extends through the eighth opening, (h) then extends across the gap, (i) then extends through the fourth opening to a third location exterior to the midsole, (j) then engages the first end of the second strap, (k) then extends through the third opening, (l) then extends across the gap, (m) then extends through the sixth opening to a fourth location exterior to the midsole, (n) then engages the second end of the first strap, and (o) then extends through the fifth opening, wherein applying tension to the tensioning member: (a) contracts the gap so that the first side portion and the second side portion of the sole structure are moved closer together and (b) tightens the first strap and the second strap around the upper.

20. The article of footwear according to claim 19, wherein the first end of the first strap includes a first loop, the second end of the first strap includes a second loop, the first end of the second strap includes a third loop, and the second end of the second strap includes a fourth loop, and wherein the intermediate portion of the tensioning member: (a) engages the first end of the first strap by extending through the first loop, (b) engages the second end of the first strap by extending through the second loop, (c) engages the first end of the second strap by extending through the third loop, and (d) engages the second end of the second strap by extending through the fourth loop.

* * * * *